US006822665B2

(12) United States Patent
Sugiyama et al.

(10) Patent No.: US 6,822,665 B2
(45) Date of Patent: Nov. 23, 2004

(54) THERMAL HEAD AND CONTROLLER FOR CONTROLLING THE SAME

(75) Inventors: Hayami Sugiyama, Ise (JP); Takashi Kubota, Ise (JP); Hiroshi Matsuda, Ise (JP); Kazunori Masukawa, Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 85 days.

(21) Appl. No.: 09/800,504

(22) Filed: Mar. 8, 2001

(65) Prior Publication Data

US 2001/0033320 A1 Oct. 25, 2001

(30) Foreign Application Priority Data

Mar. 9, 2000 (JP) ..... 2000-065474

(51) Int. Cl.[7] ..... B41J 2/335
(52) U.S. Cl. ..... 347/200; 347/202; 347/207
(58) Field of Search ..... 347/200, 207, 347/208, 202

(56) References Cited

U.S. PATENT DOCUMENTS

| | | | |
|---|---|---|---|
| 4,742,362 | A | 5/1988 | Takoshima et al. |
| 5,012,258 | A | 4/1991 | Sasaki |
| 5,182,574 | A | 1/1993 | Kato et al. |
| 5,706,043 | A | 1/1998 | Okada et al. |

FOREIGN PATENT DOCUMENTS

| | | |
|---|---|---|
| DE | 40 39 187 | 9/1991 |
| JP | 64-58566 | 3/1989 |
| JP | 1-206069 | 8/1989 |
| JP | 10-138541 | 5/1998 |
| JP | 10-151784 | 6/1998 |
| WO | WO99/58340 | 11/1999 |

*Primary Examiner*—Huan Tran
(74) *Attorney, Agent, or Firm*—Oblon, Spivak, McClelland, Maier & Neustadt, P.C.

(57) ABSTRACT

A thermal head includes a metal substrate; an insulating layer formed on the surface of the metal substrate; a plurality of heating elements disposed on the surface of the insulating layer, the heating elements being arranged with a predetermined pitch along a plurality of lines in a main scanning direction, the plurality of lines being spaced from each other in a paper feeding direction perpendicular to the main scanning direction; and a heat radiating element projecting from the surface of the metal substrate to the side where the insulating layer is disposed. In this structure, although most of heat generated by the respective heating elements is transferred to an ink ribbon or print paper, residual partial heat is absorbed by heat radiating means via the insulating layer and radiated into the atmosphere. This suppresses thermal interference among the heating elements. A thermal head controller is provided for controlling the thermal head for use in a printer.

18 Claims, 27 Drawing Sheets

THERMAL HEAD AND CONTROLLER FOR CONTROLLING THE SAME

BACKGROUND OF THE INVENTION

1. Field of the Invention

The present invention relates to a thermal head capable of printing two lines at the same time using two lines of heating elements, and to a thermal head capable of performing preheating using one of two lines of heating elements while performing printing using the other one of two lines of heating elements thereby achieving a high-speed printing operation.

The present invention also relates to a thermal head controller, and more particularly, to a thermal head controller for controlling a thermal head including a preheating heater and a printing heater.

2. Description of the Related Art

FIG. 23 illustrates a thermal head disclosed in Japanese Unexamined Patent Application Publication No. 64-58566, wherein FIG. 23A is a top view of the thermal head and FIG. 23B is a cross-sectional view taken along line XXIIIB of FIG. 23A. In FIG. 23, reference numerals 501*a* and 501*b* denote ceramic substrates, and reference numeral 517 denotes a common electrode formed of a bulk material.

FIG. 24 illustrates a thermal head disclosed in Japanese Unexamined Patent Application Publication No. 10-151784, wherein FIG. 24A is a top view of the thermal head and FIG. 24B is a cross-sectional view taken along line XXIVB of FIG. 24A. In FIG. 24, reference numeral 602 denotes a metal substrate having a projection 603, and reference numerals 608 and 611 denote heating resistors.

FIG. 25 illustrates a conventional thermal head, wherein FIG. 25A is a top view of the thermal head and FIG. 25B is a cross-sectional view taken along line XXVB of FIG. 25A. In FIG. 25, reference numeral 701 denotes a substrate formed of single silicon crystal, and reference numeral 707 denotes a common electrode. Reference numeral 702 denotes a through-hole formed in the common electrode 707, wherein the inner surface of the through-hole is plated with a conductive metal 703. Reference numerals 704 and 705 denote heating resistors.

FIG. 26 illustrates another conventional thermal head, wherein FIG. 26A is a top view of the thermal head and FIG. 26B is a cross-sectional view taken along line XXVIB of FIG. 26A. In FIG. 26, reference numerals 858, 854, 863 and 864 denote heating resistors, and reference numeral 852 denotes glaze glass.

In the case of the thermal head shown in FIG. 23, there is a difference in thermal expansion coefficient between the common electrode 517 and the substrate 501*a* or 501*b*, and the difference in thermal expansion coefficient can cause partial removal of the common electrode 517. Thus, performance degradation occurs as the thermal head is used for a long period of time.

In the case of the thermal head shown in FIG. 24, the substrate 602 is heated by a common current flowing through the projection 603 which is a part of the substrate 602. As a result, thermal interference occurs between the heating element 608 and the heating element 611. This makes it difficult to control the heating elements 608 and 611 independently of each other.

In the case of the thermal head shown in FIG. 25, a complicated process is needed to form the through-hole 702 through the substrate of single silicon crystal.

In the case of the thermal head shown in FIG. 26, if the heating resistors 853 and 854 are located very close to the heating resistors 863 and 864, interference due to heat storage in a partial glaze occurs because the heating resistors 853, 854, 863 and 864 are formed on the same partial glaze. The interference can cause the thermal head to become thermally uncontrollable. Although the above problem can be avoided by increasing the distance between two lines of heating resistors, the contact condition between the thermal head and a platen roller (not shown) which urges print paper against the thermal head becomes poor. To improve the contact condition, it is needed to increase the diameter of the platen roller or increase the force applied to the platen roller.

In the conventional thermal head, the thermal head heater is continuously energized until a needed intensity of color is obtained each time a line is printed. In this technique, the printed color intensity increases as the temperature (amount of heat) of the thermal head increases.

When respective colors of yellow, magenta, and cyan are printed on paper, no color appears during a particular period after turning on the thermal head, wherein the period in which no color appears varies depending upon the color. If, each time a line is printed, the thermal head is energized during a period in which no color appears plus a period needed to obtain a desired intensity of color, a long printing time is needed, that is, the printing speed becomes low.

One technique to avoid the above problem is to preheat paper using a preheating heater (preheater) to a temperature which is very close to but lower than a minimum temperature needed to develop a color. In this technique, a printing thermal head heater is used to further heat the paper to develop a color. Thus, color is developed with no delay and thus the problem of the reduction in the printing speed is avoided.

Although most of the heat generated by the preheater is consumed to preheat print paper, the heat is partially accumulated in the preheater and parts in the vicinity of the preheater. As a result, when the same amount of heat is generated by the thermal head heater over the entire surface of paper, the printed color intensity is low at a line (first line) at which the printing is started and the printed color intensity increases as the printing operation advances toward a final line as shown in FIG. 27. That is, nonuniformity in printed color density occurs.

Furthermore, the preheating can cause a color to be developed in a white-data area in which any color should not appear. In the case where the intensity specified by print data varies across print paper, the preheating can cause a deviation in color intensity from the specified intensity.

In the case where printing is performed using both a printing thermal head and a preheating heater, if the printing and the preheating are performed at the same time, a high-capacity power supply capable of supplying a high current with a high voltage is needed to drive the thermal head, and a complicated configuration is needed.

SUMMARY OF THE INVENTION

In view of the above, it is an object of the present invention to provide a thermal head which is formed of a material which does not cause removal, which can be produced without needing complicated processing, and which has less thermal interference.

It is another object of the present invention to provide a controller for controlling a thermal head, capable of controlling the thermal head without producing nonuniformity in color intensity caused by preheating using a preheater and without needing a high-voltage/high-current power supply for driving the thermal head.

According to an aspect of the present invention, there is provided a thermal head comprising: a metal substrate; an insulating layer formed on the surface of the metal substrate; a plurality of heating elements disposed on the surface of the insulating layer, the heating elements being arranged with a predetermined pitch along a plurality of lines in a main scanning direction, the plurality of lines being spaced from each other in a paper feeding direction perpendicular to the main scanning direction; and a heat radiating element projecting from the surface of the metal substrate to the side where the insulating layer is disposed. Note that the heat radiating element does not include a member serving as a path for supplying a current to the heating elements.

In this structure, although most of heat generated by the respective heating elements is transferred to an ink ribbon or print paper, residual partial heat is absorbed by heat radiating means via the insulating layer and radiated into the atmosphere. This suppresses thermal interference among the heating elements.

In this thermal head according to the present invention, a part, in contact with one line of the heating elements, of the insulating layer and a part, in contact with a directly adjacent line of the heating elements, of the insulating layer may be separated from each other by the heat radiating element.

This further suppresses thermal interference among the heating elements.

In this thermal head according to the present invention, preferably, the heat radiating element is disposed at least in a part of a region between the metal substrate and a gap between one line of the heating elements and an adjacent line of the heating elements, and a part, in contact with one line of the heating elements, of the insulating layer and a part, in contact with a directly adjacent line of the heating elements, of the insulating layer are connected to each other in a region in contact with the gap so that heat can be conducted therebetween.

In this structure, it is possible to prevent print paper preheated by one of two lines of the heating elements from being cooled when it passes over the intermediate part between the two lines of the heating elements.

In this thermal head according to the present invention, the heat radiating element may be formed integrally with the metal substrate.

This structure allows heat absorbed by the heat radiating element to be transferred more easily into the substrate and radiated. As a result, the effective radiating area increases, and thus a greater amount of heat is radiated into the atmosphere.

In the thermal head according to the present invention, portions, in contact with the heating elements, of the insulating layer may protrude in a direction toward the heating elements.

This structure ensures that heat is transferred to print paper in a more reliable fashion.

In the thermal head according to the present invention, the heating elements may be disposed such that the location, in the main scanning direction, of each heating element is coincident with the location of one of heating elements arranged in an adjacent line.

In this structure, it is possible to simultaneously generate heat in two lines of heating elements, and thus an increase in the printing speed is achieved.

In the thermal head according to the present invention, the heating elements may be disposed such that the location, in the main scanning direction, of each heating element is shifted by ½ pitch relative to the location of one of heating elements arranged in an adjacent line.

In this structure, a greater dot density can be achieved, and thus higher-precision printing becomes possible.

In the thermal head according to the present invention, the metal substrate may include a fin formed on a side opposite to the side on which the insulating layer is formed.

In this structure, a greater heat radiating area is provided to radiate a greater amount of heat into the atmosphere.

In the thermal head according to the present invention, two conductor patterns for supplying a current to each heating element to generate heat are connected to each heating element, on the side opposite to the insulating layer.

According to another aspect of the present invention, there is provided a thermal head controller for controlling a thermal head for use in a printer, the thermal head serving to form an image with at least one color on print paper, the thermal head including a preheating heater and a printing heater, the thermal head controller comprising: preheating control means for controlling preheating of each line performed by the preheating heater; and amount-of-heat correction means for correcting the amount of heat generated by the preheating heater for each line such that the effective amount of preheating heat is maintained substantially constant over all lines.

In this construction, even if heat generated by the preheating heater is stored in a part near the preheating heater, nonuniformity in color intensity does not occur because the effective amount of heat given to each line during the preheating process is maintained substantially constant.

The thermal head controller according to the present invention may further comprise temperature detection means, and the amount-of-heat correction means may correct the amount of heat in accordance with a temperature value detected by the temperature detection means.

The temperature detection means may include one of or both of an inside-of-printer temperature detector and a preheater temperature detector.

In the thermal head controller according to the present invention, the amount-of-heat correction means may correct the amount of heat depending upon a printing mode, a temperature inside the printer, a preheater temperature, and a line number.

In this case, at the beginning of a printing operation for one surface of paper, the amount-of-heat correction means may select data to be used depending upon the printing mode, the temperature inside the printer, and the preheater temperature, and the amount-of-heat correction means may determine, from the data, an amount of correction of heat depending upon the line number and correct the amount of heat by the determined amount of correction during the printing operation for the one surface of paper.

This construction makes it possible to correct the amount of heat generated in the preheating process for each line depending upon the amount of heat stored in parts other than a part which should be preheated by the preheating heater.

In the thermal head controller according to the present invention, the amount-of-heat correction means may correct the amount of heat depending upon a printing mode, a temperature inside the printer, and a preheater temperature.

In this case, at the beginning of a printing operation for one surface of paper, the amount-of-heat correction means may select data to be used depending upon the printing mode and the temperature inside the printer, and the amount-of-heat correction means may determine, from the data, an amount of correction of heat depending upon the preheater temperature and correct the amount of heat by the determined amount of correction during the printing operation for the one surface of paper.

This construction makes it possible to correct the amount of heat generated in the preheating process for a particular preheater temperature depending upon the amount of heat stored in parts other than a part which should be preheated by the preheating heater.

In the thermal head controller according to the present invention, preferably, the preheating control means energizes the preheating heater in a period in which printing is not performed by the printing heater and which is within a printing cycle.

In this configuration, the printing heater and the preheating heater are not energized at the same time during the same printing cycle, and thus preheating and printing can be performed without needing a special high-voltage and high-current power supply for driving the thermal head.

In the thermal head controller according to the present invention, the preheating control means may include: a first gate circuit for generating, in response to starting of a printing cycle for each line, a first signal indicating an energization start time of the preheating heater; a second gate circuit for generating a second signal indicating an energization end time at which the energizing of the preheating heater should be ended before starting energizing of the printing heater; and a third gate circuit for generating a preheating signal in accordance with the first signal and the second signal such that the preheating signal is activated over a period from the energization start time of the preheating heater to the energization end time, wherein the energization end time is changed by the amount-of-heat correction means.

In this construction, the period during which the preheater is energized is specified by the first signal generated by the first gate circuit and the second signal generated by the second gate circuit. Herein, if the first and second signals are set so that the timings of the energization start time and the energization end time of the preheating heater become earlier the energization start time of the printing heater, it becomes possible to energize, in each printing cycle, the preheating heater during a period in which printing is not performed by the printing heater.

Furthermore, the second gate circuit may include a counter which counts a predetermined clock signal and outputs a signal which determines the end time when the counted number of pulses reaches a value predetermined as a preset value.

With this construction, if the counter is set such that before the energizing of the printing heater is started, the count value will reach a value corresponding to the preheat end time, the preheating using the preheater can be ended when the count value reaches the preset value. This makes it possible to end the energization of the preheating heater before starting the energization of the printing heater in the same printing cycle.

According to still another aspect of the present invention, there is provided a thermal head controller for controlling a thermal head for use in a printer, the thermal head serving to form an image with one or more colors on print paper, the thermal head including a preheating heater and a printing heater, the thermal head controller comprising: signal generating means for generating a control pulse signal serving as a reference signal according to which the energizing of the printing heater is controlled; and preheating control means for controlling the energizing of the preheating heater by means of counting the control pulse signal.

In this construction, the energization start time of the preheating heater is controlled by means of counting the control pulse signal which is used to control the energization of the printing heater. This makes it possible to control the energization start time of the preheating heater without resulting in an increase in complexity of the circuit. Furthermore, by setting the control pulse signal to have a proper pattern, it is possible to control both the energization of the preheating heater and the energization of the printing heater in a highly effective fashion thereby increasing the printing speed using a simple configuration.

In the thermal head controller according to the present invention, the preheating control means may include: a counter which counts pulses of the control pulse signal and outputs a predetermined signal when the counted number of pulses reaches a value predetermined as a preset value; a flip flop for latching predetermined data and outputting it in response to the predetermined signal serving as a trigger signal; and a switch connected in series to the preheating heater, for controlling the energizing of the preheating heater in accordance with a signal output from the flip flop.

In this construction, when the count value of the control pulse signal reaches the preset value, the counter outputs a predetermined signal in the form of, for example, a pulse. In response to this predetermined signal serving as a trigger signal, the flip flop outputs predetermined data. That is, when the count value reaches the preset value, the flip flop produces a transition of its output thereby indicating that the count value has reached the preset value.

In the thermal head controller according to the present invention, before starting preheating using the preheating heater, the counter inputs a value as a preset value indicating a time at which the preheating should be started.

DESCRIPTION OF THE PREFERRED EMBODIMENTS

Figure 1A:
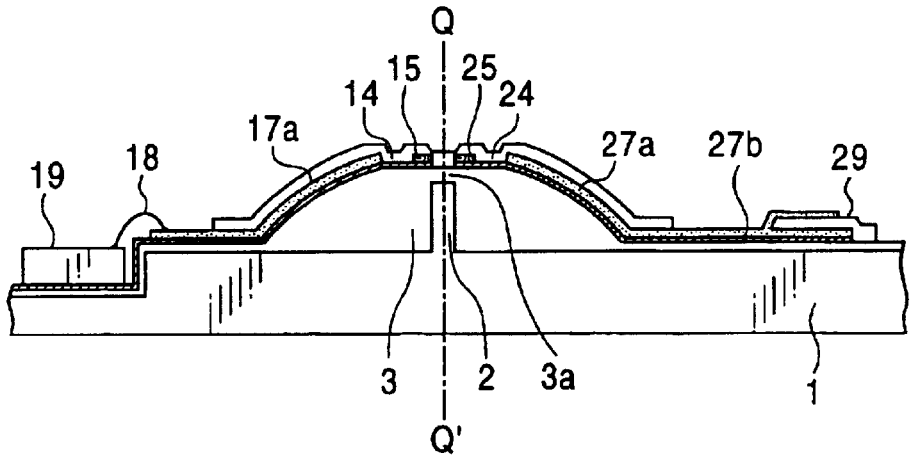
FIG. 1 is a block diagram illustrating the structure of a thermal head according to an embodiment of the present invention.
Figure 1B:
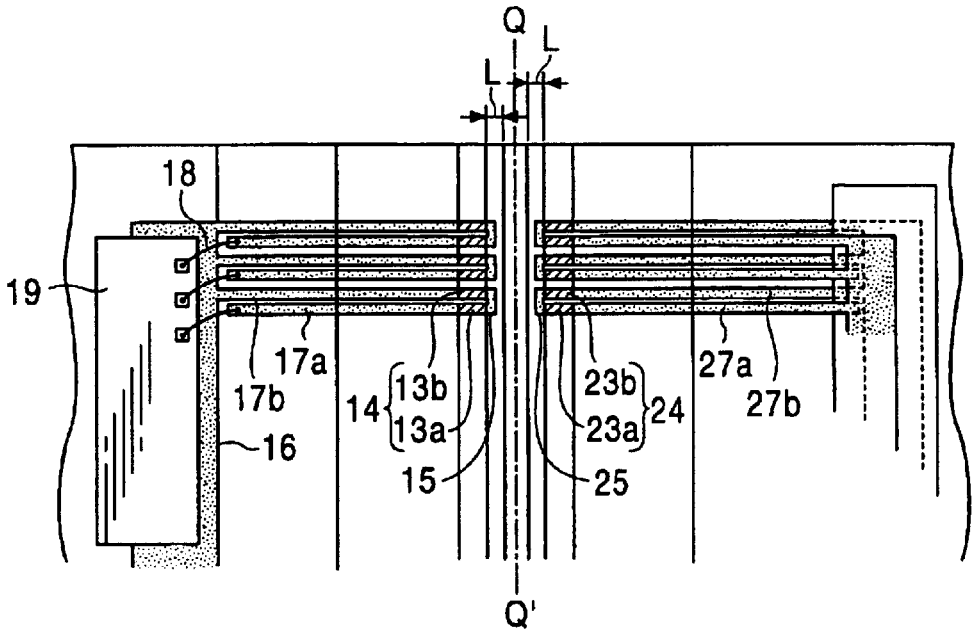

FIG. 1 illustrates the structure of a thermal head according to a first embodiment of the present invention, wherein FIGS. 1A and 1B are a cross-sectional view and a top view thereof, respectively. This thermal head has a structure symmetrical about a center line QQ'.

In FIG. 1, reference numeral 1 denotes a stainless steel substrate having a substrate projection 2 and a radiating fin (not shown) for radiating heat generated by heating elements 14 and 24. The substrate projection 2 is formed integrally with the stainless steel substrate 1 so that heat is transferred from a glaze glass layer formed directly on the stainless steel substrate 1 and the substrate projection 2 to the radiating fin (not shown) via the substrate projection 2 and the stainless steel substrate 1.

The glaze glass 3 is an insulating element serving to absorb heat remaining in the heating elements 14 and 24 and transfer the absorbed heat to the stainless steel substrate 1. The glaze glass 3 is formed on the substrate 1, for example, by coating glass paste on the substrate 1 and then baking it. In the example shown in FIG. 1, a part of the glaze glass on the side of the heating element 14 and a part on the side of the heating element 24 are connected to each other via a connection part 3*a* so that heat can travel between them.

Reference numeral 14 denotes a heating element consisting of a pair of heater segments 13*a* and 13*b* forming one dot.

Reference numeral 15 denotes an intermediate electrode connected to the heater segments 13*a* and 13*b*.

Reference numeral 16 denotes a common electrode connected to a conductor pattern 17*b* of the heating element 14*a* and also to a power source (not shown). Reference numeral 17*a* denotes a conductor pattern connected to the heater segment 13*a* of the heating element 14 and also to a bonding wire 18. Reference numeral 17*b* denotes a conductor pattern connected to the heater segment 13*b* of the heating element 14 and also to the common electrode 16.

Reference numeral 19 denotes a control IC which is connected to the conductor pattern 17*a* via the bonding wire 18. The control IC 19 is connected to the power supply (not shown) and serves to control an on-off operation of the heating element 14 in accordance with a printer control signal.

Reference numeral 24 denotes a heating element consisting of heater segments 23*a* and 23*b* formed on the glaze glass 3, for preheating print paper. In the case where the heating element 24 is used for preheating, the amount of heat generated by the heating element 24 is set to be slightly lower than a threshold above which thermal transfer of a subliming dye or thermal development of a color occurs.

Reference numeral 29 denotes an insulating layer. Reference numerals 25 to 28 correspond to reference numerals 15 to 18, respectively.

Now, the operation is described below.

If print paper is set on a printer including this thermal head, the print paper is fed onto the heating element 24 by a transport mechanism (not shown). When the heating element 24 receives the print paper thereon, the heating element 24 generates heat corresponding to a current supplied from a controller (not shown). In this heating operation, because the amount of heat generated by the heating element 24 is set to a value for preheating, printing on the print paper does not occur.

The print paper is then transported to the heating element 14 by the transport mechanism (not shown). If the heating element 14 receives the print paper thereon, the heating element 14 generates heat corresponding to a current supplied from the controller (not shown). The sum of heat generated by the heating element 14 and heat generated in the preheating process causes thermal transfer of a subliming dye or thermal development of a color to occur and thus a color with a particular intensity is printed on the print paper.

Although most of the heat generated by the heating elements 14 and 24 is consumed to thermally transfer a subliming dye or thermally develop a color, residual heat travels to the radiating fin of the substrate 1 via the glaze glass 3 and is radiated into the atmosphere. Herein, a greater amount of heat is absorbed by the substrate projection 2 and thus thermal interference between the heating element 14 and the heating element 24 is suppressed.

Because the connection part 3*a* is disposed between the heating element 14 and the heating element 24, when the print paper preheated by the heating element 14 or the heating element 24 passes by the middle between the heating element 14 and the heating element 24, the print paper is prevented from being brought into direct contact with the connection part 3*a* and thus heat removal due to thermal conduction via the connection part 3*a* is suppressed.

Furthermore, because the heating elements are grouped into a set of heating elements used for preheating and a set of heating elements used for printing, it is not needed to pass a large current through all heating elements in a short time as is needed when all heating elements are used for printing. This suppresses degradation of the heating elements.

Figure 2A:
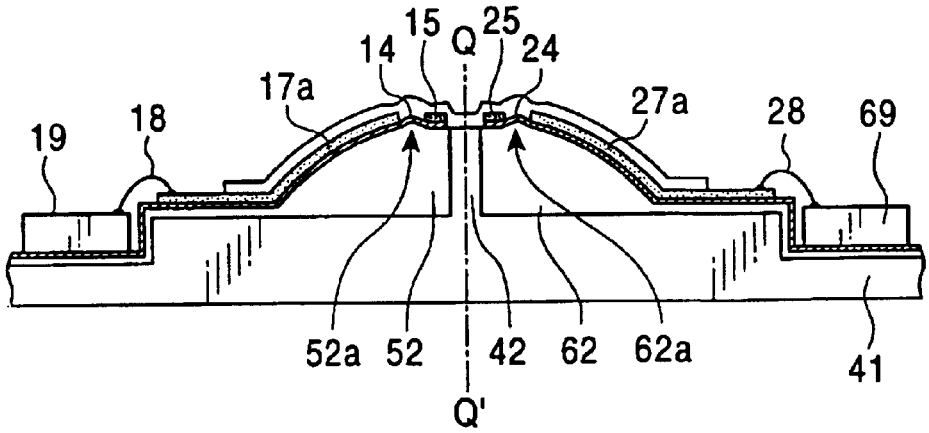
FIG. 2 is a block diagram illustrating the structure of a thermal head according to another embodiment of the present invention.
Figure 2B:
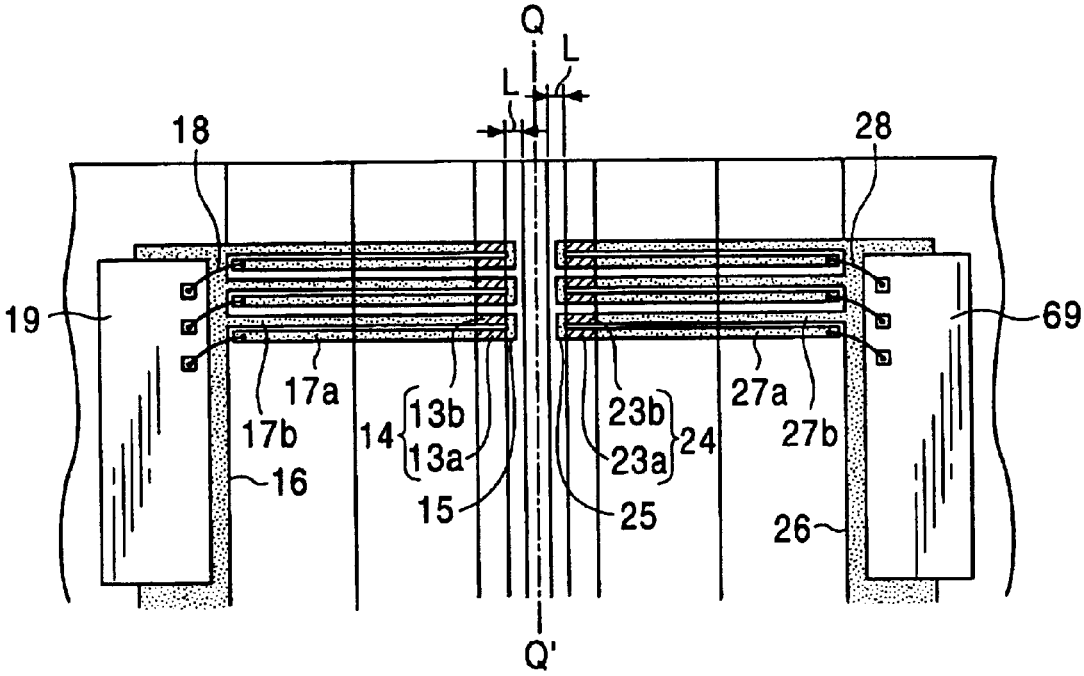

FIG. 2 illustrates the structure of a thermal head according to a second embodiment of the present invention, wherein FIGS. 2A and 2B are a cross-sectional view and a top view thereof, respectively. This thermal head has a structure symmetrical about a center line QQ'. In FIG. 2, similar parts to those in FIG. 1 are denoted by similar reference numerals, and they are not described in further detail herein.

The second embodiment shown in FIG. 2 is different from the first embodiment shown in FIG. 1 in that the glaze glass has protrusions 52*a* and 62*a* and the glaze glass is separated into two parts by a substrate projection 42.

In FIG. 2, reference numeral 41 denotes a stainless steel substrate including the substrate projection 42 and a radiating fin (not shown) for radiating absorbed heat. The substrate projection 42 receives heat transferred into the glaze glass 52 from the heating element 14 and transfers it to the radiating fin (not shown). In the example shown in FIG. 2, the protrusion 52*a* of the glaze glass 52 is formed under the heating element 14. As a result of formation of the protrusion 52*a*, the heating element 24 is protruded upward and thus it is ensured that print paper can come into contact with the heating element 24 in a highly reliable fashion thereby making it possible to apply a precise amount of heat to the print paper.

Reference numeral 69 denotes a control IC which is connected to a conductor pattern 18*a* via a bonding wire 28. The control IC 69 is connected to a power supply (not shown) and serves to control an on-off operation of the heating element 24 in accordance with a printer control signal.

Reference numerals 62 and 62*a* correspond to reference numerals 52 and 52*a*, respectively.

The operation is described below.

If print paper is set on a printer including this thermal head, the print paper is fed onto the heating element 24 by a transport mechanism (not shown). If the heating element 24 receives the print paper thereon, the heating element 24 generates heat under the control of the controller (not shown). The amount of heat generated by the heating element 24 in this heating operation is set such that printing on the print paper does not occur.

The print paper is then transported to the heating element 14 by the transport mechanism (not shown). If the heating element 14 receives the print paper thereon, the heating element 14 generates heat under the control of the controller (not shown) to print on the print paper.

Heat generated by the heating elements 14 and 24 travels to the radiating fin of the substrate 1 via the glaze glass 52 and 62 and is radiated into the atmosphere. Herein, heat flowing between the heating elements 14 and 24 is transferred to the radiating fin via the substrate projection 42. As a result, the amount of heat flowing between the glaze glass 52 and the glaze glass 62 is limited. Thus, thermal interference between the heating elements 14 and 24 is suppressed. In the present embodiment, because there is no glaze glass on the substrate projection 42 and the heat flowing between the glaze glass 52 and the glaze glass 62 is suppressed, the thermal interference between the heating elements 14 and 24 is more effectively prevented than in the first embodiment. Furthermore, the protrusions disposed under the heating elements make the heating elements protrude upward thereby ensuring heat transfer to print paper.

In the first and second embodiments, the time needed for the heat generated by the heating elements 14 and 24 to reach the substrate projection 42 is determined by the length of the path from the heating elements 14 and 24 to the substrate projection 42. Therefore, the cooling characteristic of the heating elements 14 and 24 is determined by the length L shown in FIG. 1 or 2. That is, the cooling rate increases with decreasing length L. The length L is usually selected in the range of several $\mu$m to several mm. The thermal head according to the present invention may be produced, for example, according to a technique disclosed in Japanese Unexamined Patent Application Publication No. 10-138541.

Figure 4A:
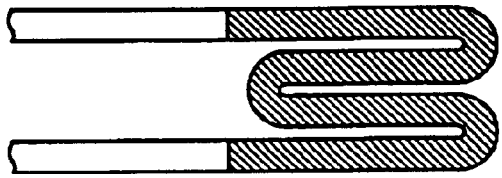
FIG. 4 is a block diagram illustrating the structure of a thermal head according to still another embodiment of the present invention.

Although in the first and second embodiments, each of the heating elements 14 and 24 includes heater segments 13*a* and 13*b*, or 23*a* and 23*b*, each heating element may be formed of a heater segment in a C-like shape. Alternatively, each heating element 14, 24 may be formed into a shape such as that shown in FIG. 4A. More specifically, a curved current path such as a shaded portion shown in FIG. 4A is disposed in an area to be heated, and similar heating elements each having such a curved current path are uniformly arranged in a particular area so that the amount of heat generated in respective portions in this area becomes uniform. That is, it is desirable that each single heating element be formed so as to have an electrical path having as small a width as possible and curved in an area to be heated, and a plurality of similar heating elements be uniformly distributed in the particular area.

Figure 4B:
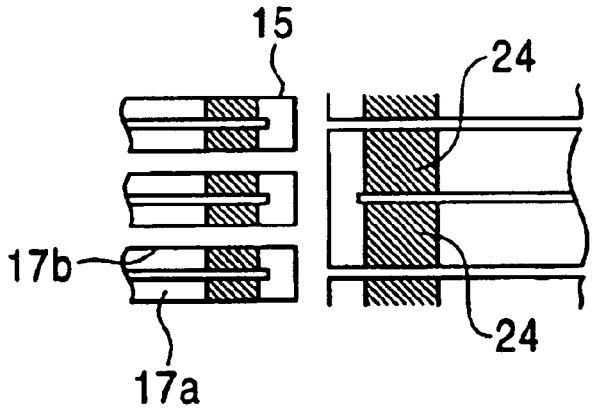

The shapes of the heating element 24 is not necessarily needed to be the same as that of the heating element 14. For example, the heating element 24 may be formed to have a shape represented by shading in FIG. 4B. That is, the heating elements may have an arbitrary shape, although it is needed that two conductor patterns 17*a* and 17*b* connected to a heating element should extend in the same direction and two conductor patterns 27*a* and 27*b* connected to another heating element should also extend in the same direction. Furthermore, the heating elements are not necessarily needed to be symmetrical about the center line QQ'.

Figure 3A:
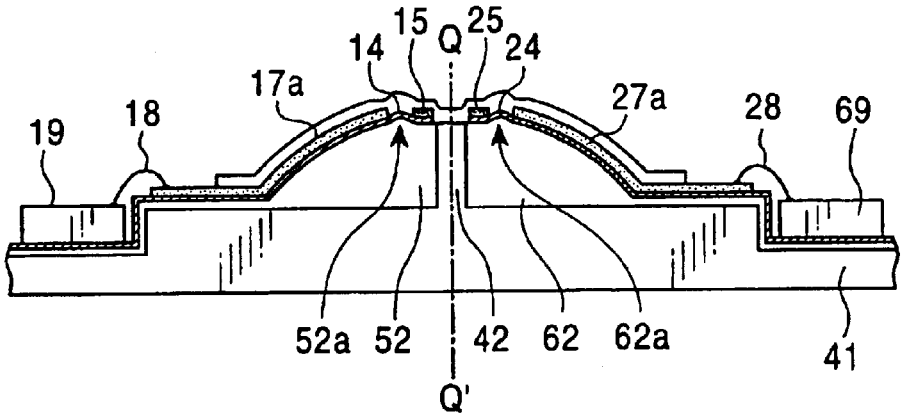
FIG. 3 is a block diagram illustrating the structure of a thermal head according to still another embodiment of the present invention.
Figure 3B:
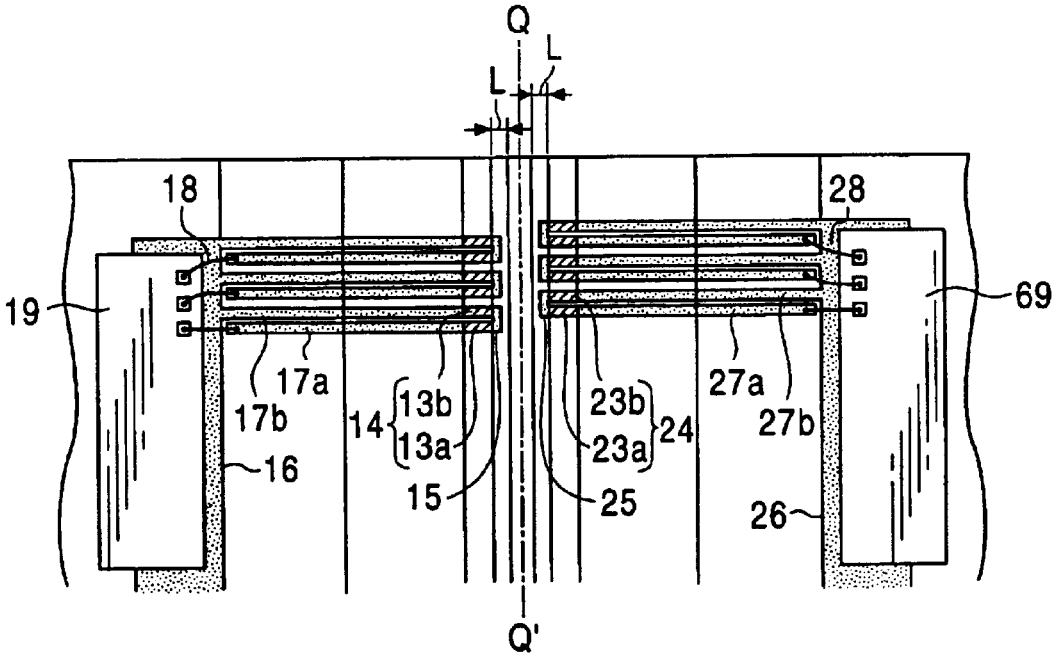

In the first and second embodiments, the heating element 24 is used for preheating, the heating element 24 may be used for printing. In this case, the heating elements 14 and 24 may be controlled at the same time such that they generate as much heat as is necessary to develop colors on respective lines with which the respective heating elements are in contact thereby printing two lines at a time. In this case, if paper is fed at the same rate, printing two lines at a time results in an increase in the printing speed by a factor of two. Furthermore, the arrangements of the heating elements on respective sides of the center line QQ' may be shifted from each other by an amount corresponding to one-half the pitch as shown in FIG. 3. In the construction, the dot density (the number of dots per unit length) in the main scanning direction becomes twice that obtained by the thermal head shown in FIG. 1, and thus a high-resolution printer can be realized.

Next, a thermal head controller according to the present invention is described below with reference to specific embodiments in conjunction with drawings.

Controller According to the First Embodiment

Figure 5:
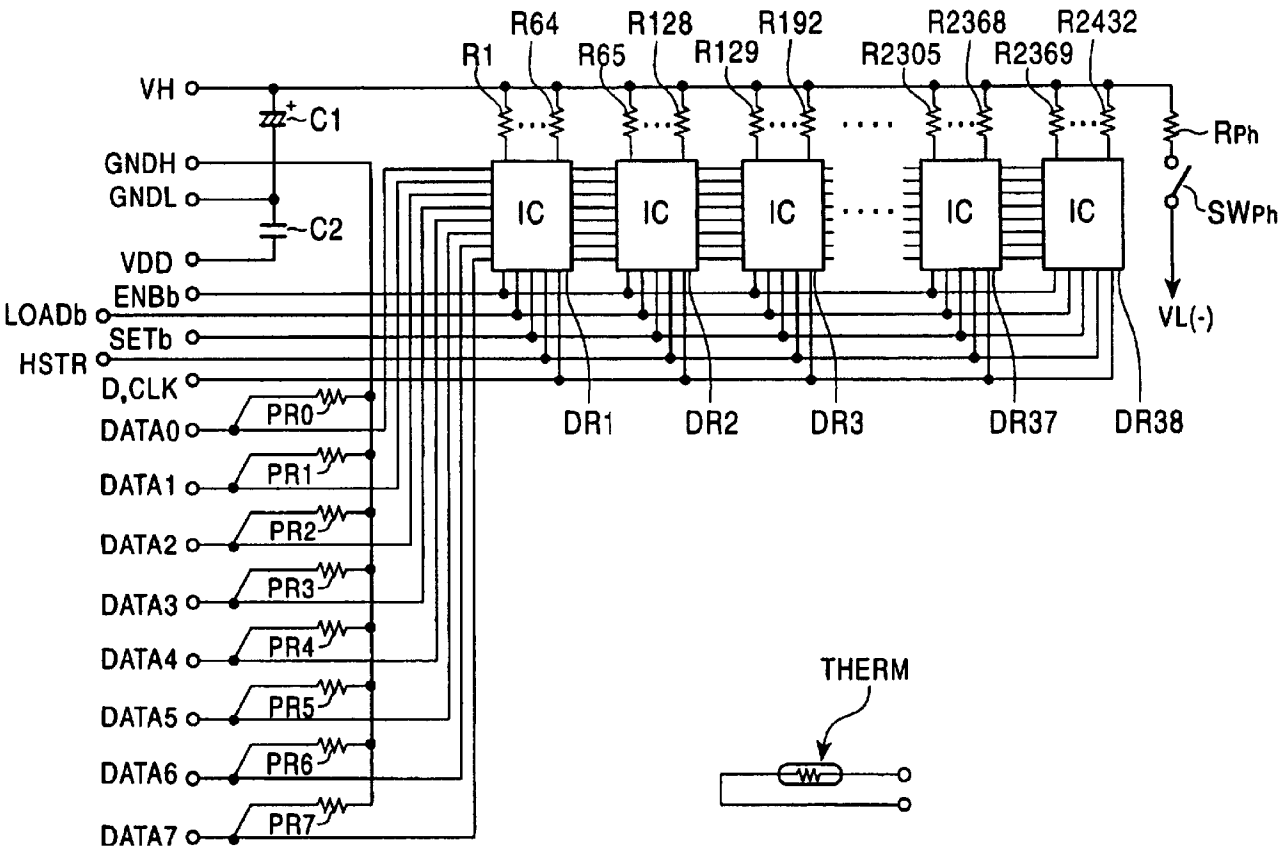
FIG. 5 is a block diagram illustrating the structure of a thermal head according to the first embodiment of the present invention.

FIG. 5 illustrates the configuration of a thermal head according to the first embodiment of the present invention. The thermal head shown in FIG. 5 includes a preheating heater and a printing heater and is used in a printer to form an image on print paper using one or more colors.

Herein, in the first embodiment, it is assumed that the thermal head is used in a printer to print a combination of three colors of yellow, magenta, and cyan which need different energy to develop respective colors wherein the respective colors of yellow, magenta, and cyan are printed separately in the corresponding printing modes. However, note that the thermal head may also be applied to a printer designed to print a single (monochrome) color. Herein, the term "printing mode" is used to describe one of operation modes in which printing of yellow, magenta, or cyan is performed. For example, a yellow printing mode is an operation mode in which yellow color is developed.

In FIG. 5, reference symbols R1 to R2432 denote 2432 printing heaters disposed in the thermal head according to the first embodiment (hereinafter, referred to as "thermal head heaters"). Each of these thermal head heaters is formed of a resistor which generates heat when being electrically energized. The thermal head heaters R1 to R2432 are arranged in a line in a direction perpendicular to a direction in which print paper (not shown) is fed. One end of each resistor serving as a thermal head heater is connected in common to a line for supplying a power supply voltage VH.

Reference symbol Rph denotes a heater for preheating (hereinafter referred to as a preheater). Reference symbol SWph denotes a switch for controlling the supply of a current to the preheater Rph. The preheater Rph and the switch SWph are connected in series between the power supply VH and a power supply VL which will be described later.

Reference symbols DR1 to DR38 denote drivers (ICs) for driving the thermal head heaters R1 to R2432. Each driver is responsible to 64 thermal head heaters of thermal head heaters R1 to R2432, and a total of 2432 (=64×38) thermal head heaters R1 to R2432 are driven by 38 drivers DR1 to DR38.

The 38 drivers DR1 to DR38 are cascaded via data lines so that one line of print data can be set into the drivers R1 to R38 by shifting print data DATA0 to DATA7 from one driver to the following driver. The drivers DR1 to DR38 include switches SW1 to SW2423 for controlling the operation of electrically energizing the thermal head heaters R1 to R2432 as will be described later, and also include a shift register for shifting print data DATA0 to DATA7, and a counter for determining a value indicating a printed color intensity.

Terminals through which print data DATA0 to DATA7 are supplied are respectively connected to a ground terminal GNDL via pull-down resistors PR0 to PR7.

Figure 6:
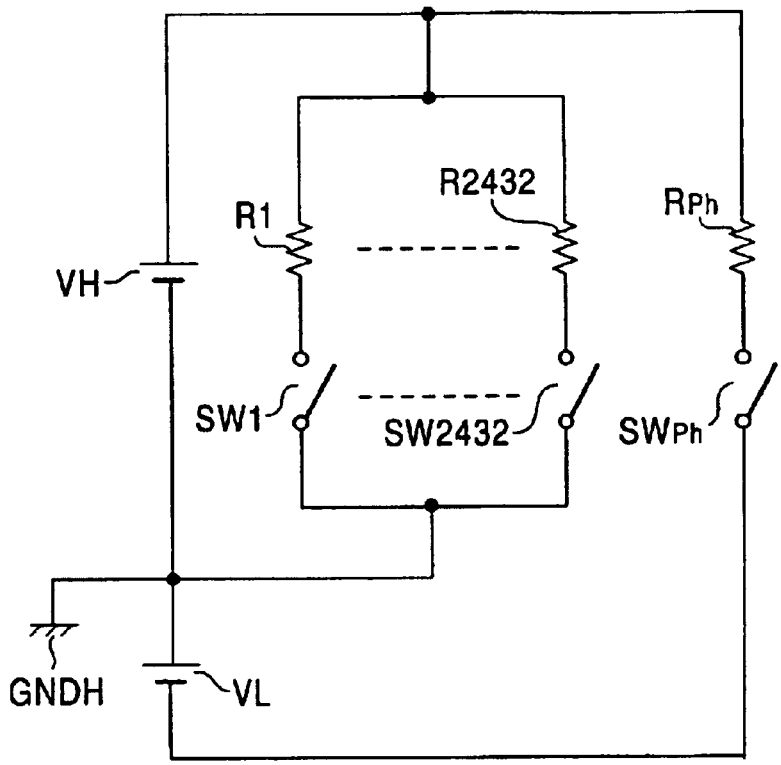
FIG. 6 illustrates thermal head heaters and associated circuit components according to the first embodiment of the present invention.

FIG. 6 illustrates electrical connections of the thermal head heater R1 to R2432 and the preheater Rph to the corresponding switches SW1 to SW2432 and SWph for controlling the operation of energizing them. As shown in FIG. 6, the switches SW1 to SW2432 are disposed in the drivers DR1 to DR38 such that each driver includes 64 switches, and each thermal head heater R1 to R2432 is connected in series to one corresponding switch, and each series connection of one thermal head heater and one switch is connected between the positive terminal of the power supply VH and the negative terminal (ground GNDH) thereof. In this configuration, some of the thermal head heaters R1 to R2432 are selectively connected to the power supply voltage VH by selectively turning on the corresponding switches of switches SW1 to SW2432, and the switches selectively connected to the power supply voltage VH generate heat. That is, any of the 2432 thermal head heaters R1 to R2432 can be separately energized via the corresponding one of the 2432 switches SW1 to SW2432, and the energized thermal head heater generates heat.

In this specific example, 2443 switches are disposed in 38 drivers DR1 to DR38 such that each driver includes 64 switches. However, the number of switches included in one driver is not necessarily needed to be equal to 64, but the number of switches included in each driver may be arbitrarily determined. For example, if a driver including 2432 switches is used, all switches may be provided by only one driver.

As shown in FIG. 6, the negative terminal of the power supply VH is connected in series to a power supply VL, and the preheater Rph and the switch SWph for controlling the operation of energizing the preheater Rph are connected in series between the positive terminal of the power supply VH and the negative terminal of the power supply VL so that when the switch SWph is turned on, a voltage equal to the sum of the voltage of the power supply VH and the voltage of the power supply VL is applied to the preheater Rph and thus a high voltage (VH+VL) is applied across the preheater.

Figure 7:
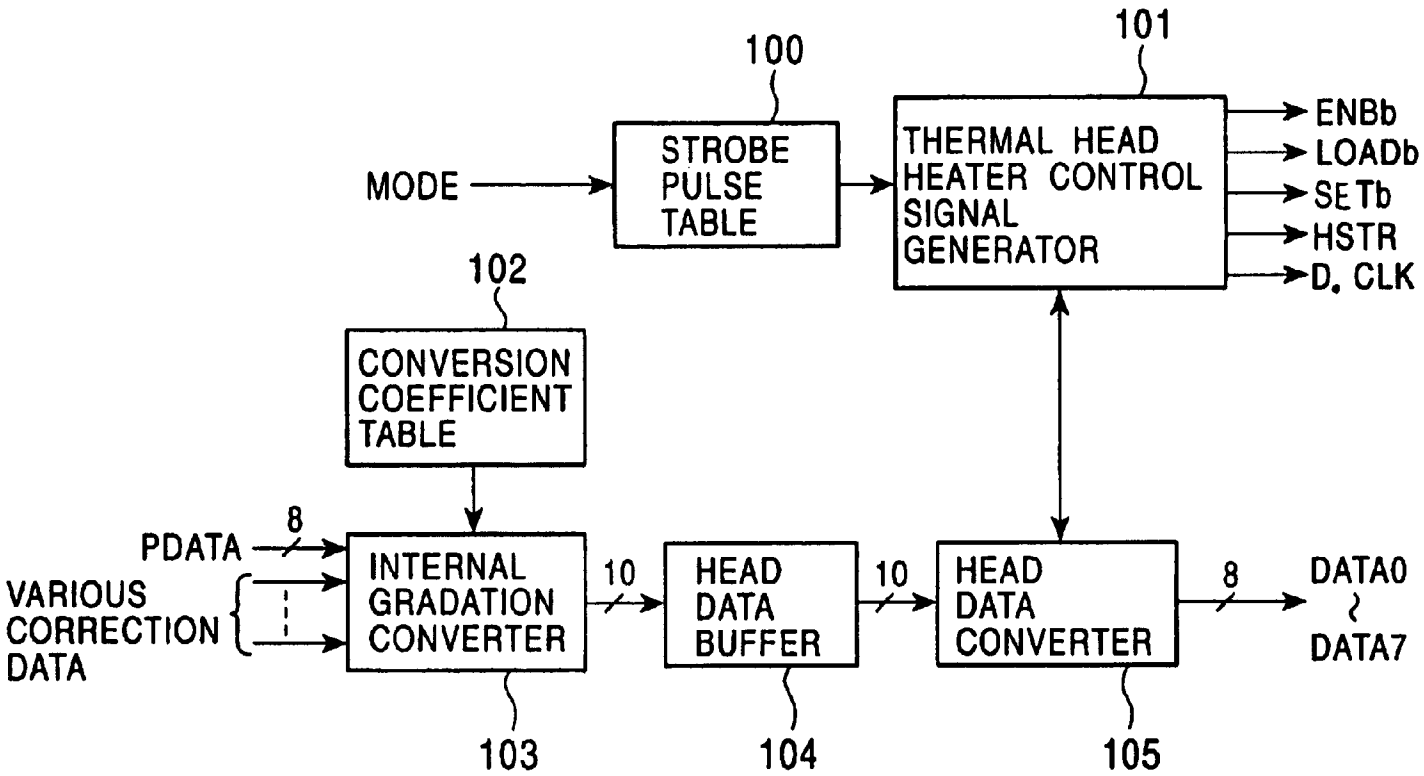
FIG. 7 is a block diagram illustrating a thermal head controller (circuit for generating various control signals and a print data signal) according to the first embodiment of the present invention.
Figure 8:
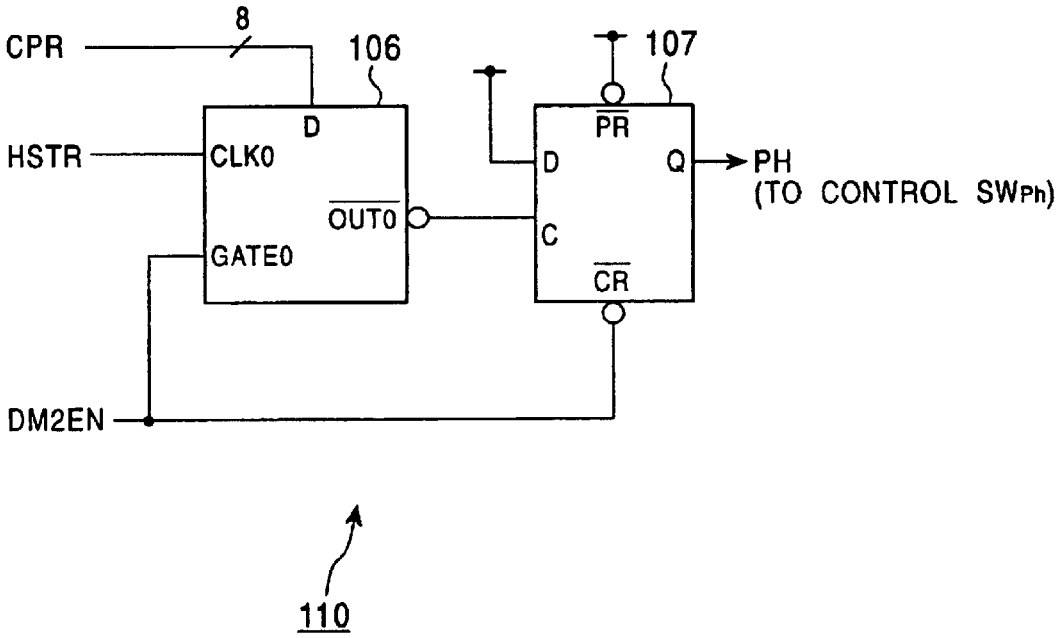
FIG. 8 is a block diagram illustrating a thermal head controller (preheat signal generator) according to the first embodiment of the present invention.
Figure 9:
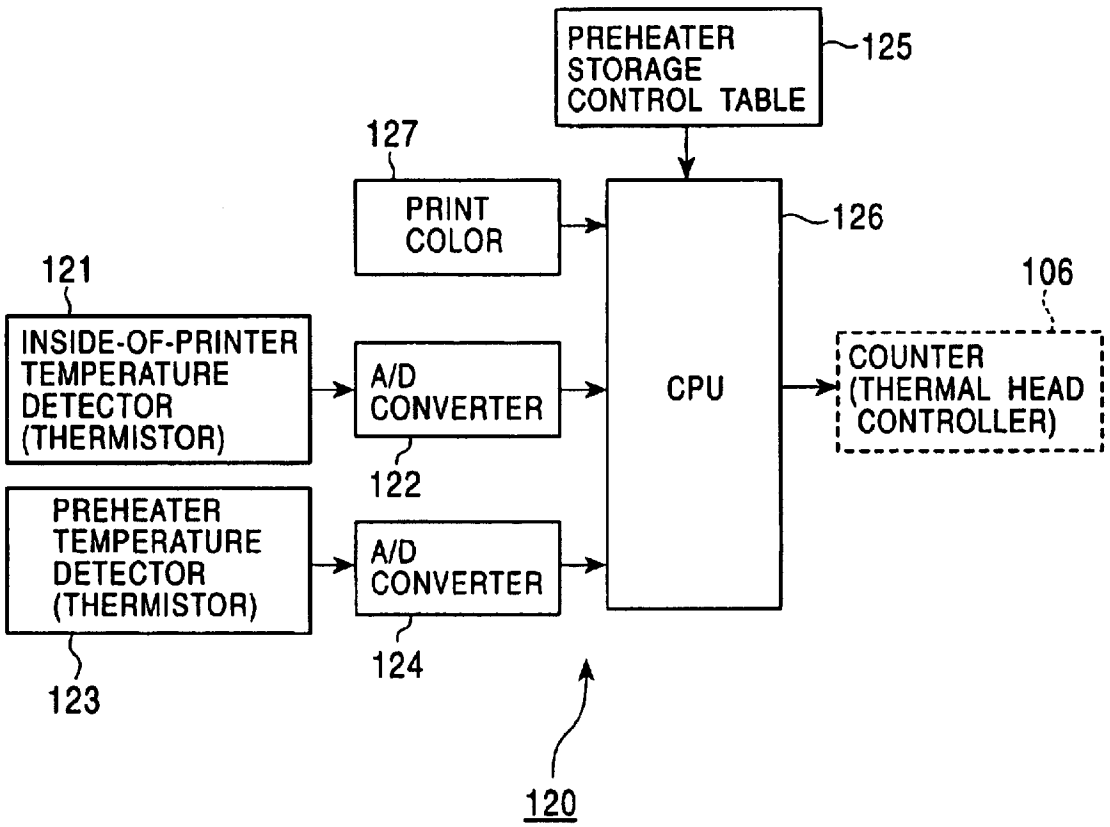
FIG. 9 is a block diagram illustrating a thermal head controller (preset value setting/correcting circuit) according to the first embodiment of the present invention.

FIGS. 7 to 9 illustrate a control circuit which is an essential part of the first embodiment and which serves to drive the thermal head shown in FIG. 5.

FIG. 7 illustrates a circuit configuration of a circuit for generating various control signals and print data. In FIG. 7, reference numeral 100 denotes a strobe pulse table which defines a pulse pattern of a strobe signal HSTR serving as a reference signal according to which the energization of the thermal head heaters R1 to R2432 are controlled depending upon the printing mode. The strobe pulse table outputs a pulse pattern in response to a print mode signal MODE specifying the printing mode in which one of colors of yellow, magenta, cyan is printed.

Reference numeral 101 denotes a thermal head heater control signal generator for generating various control signals (enable signal ENGb, load signal LOADb, set signal SETb, strobe signal HSTR, clock signal D.CLK). The strobe pulse table 100 and the thermal head heater control signal generator 101 forms signal generating means for generating a strobe signal HSTR serving as a reference signal in controlling the operation of energizing the thermal head heaters depending upon the printing mode selected from a plurality of printing modes in which respective colors are printed.

Reference numeral 102 denotes a conversion coefficient table which describes conversion coefficients used in conversion of the gradation of image data PDATA to be printed. Reference numeral 103 denotes an internal gradation converter for converting 8-bit image data PDATA input from the outside together with various correction data and the conversion coefficients into 10-bit internal gradation data. Reference numeral 104 denotes a head data buffer for temporarily storing the converted internal gradation data.

Reference numeral 105 denotes a head data converter for converting the 10-bit internal gradation data stored in the head data buffer 104 into 8-bit print data DATA0 to DATA7.

FIG. 8 illustrates a circuit configuration of a preheating signal generator 110 for generating a preheating signal PH in accordance with the strobe signal HSTR received from the above-described thermal head heater control signal generator 101. In FIG. 8, reference numeral 106 denotes a counter for counting the strobe pulses given as the strobe signal HSTR and outputting a low-level pulse signal (predetermined signal) when the counted number has reached a preset value CPR. Reference numeral 107 denotes a flip flop which, when being triggered by a pulse signal output from the counter 106, latches input data and outputs it as a preheating signal RH for controlling the preheating operation performed by the preheater Rph.

The preheating signal generator 110 and the switch SWph serve as preheat control means for controlling the timing of starting the energization of the preheater Rph thereby controlling the preheating for each line by means of counting the strobe signal HSTR which is also used as the reference signal for controlling the energization of the thermal head heaters R1 to R2432.

FIG. 9 illustrates a circuit configuration of a preset value setting/correcting circuit 120 for setting and correcting the preset value CPR. The preset value setting/correcting circuit 120 serves as amount-of-heat correction means for correcting the amount of heat generated by the preheater Rph such that the amount of preheat is maintained substantially constant over all lines.

In FIG. 9, reference numeral 121 denotes an inside-of-printer temperature detector for detecting the temperature inside the printer. Reference numeral 122 denotes an A/D (analog-to-digital) converter for converting an analog output signal of the inside-of-printer temperature detector 121 into digital form.

Reference numeral 123 denotes a preheater temperature detector for detecting the temperature of the preheater Rph. Reference numeral 124 denotes an A/D converter for converting an analog output signal of the preheater temperature detector 123 into digital form.

In the first embodiment, thermistors are employed as the inside-of-printer temperature detector 121 and the preheater temperature detector 123. The signal output from the inside-of-printer temperature detector 121 is input to the A/D converter 122, which in turn outputs a value (thermistor value PRT) corresponding to the temperature of the inside of the printer. The signal output from the preheater temperature detector 123 is input to the A/D converter 124, which in turn outputs a value (thermistor value PHT) corresponding to the temperature of the preheater.

Note that both thermistor values decrease with increasing temperature.

Reference numeral 125 denotes a preheater heat storage control table which describes the count value of the counter 106 for each line and for various parameters including the printing mode, the temperature of the inside of the printer (thermistor value PRT), and the temperature of the preheater Rph (thermistor value PHT).

Reference numeral 126 denotes a CPU (Central Processing Unit) which executes a sequence of processes for setting a preset value into the counter 106 by referring to the preheater heat storage control table 125 in accordance with the thermistor values PRT and PHT received from the A/D converters 122 and 124 and the print color 127 depending upon the printing mode.

In FIG. 5, reference symbol THEM denotes a thermistor for detecting the temperature of the thermal head.

Figure 10:
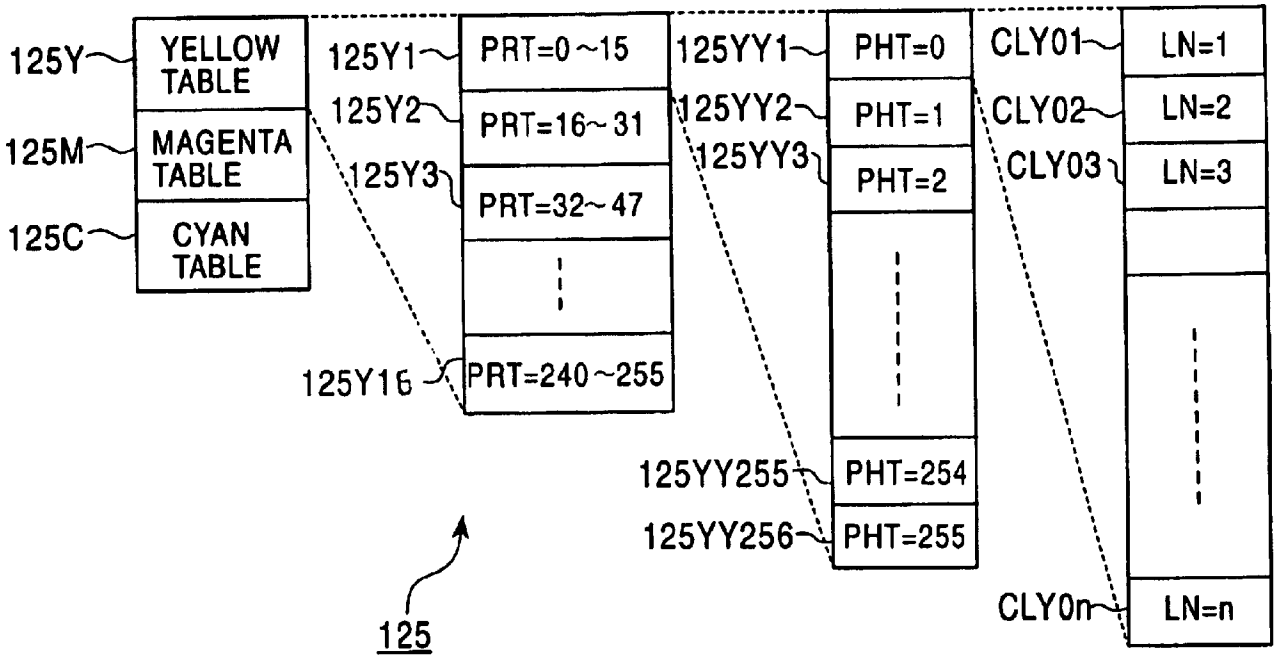
FIG. 10 illustrates a preheater heat storage control table provided in the preset value setting/correcting circuit according to the first embodiment of the present invention.

FIG. 10 illustrates an example of the preheater heat storage control table 125.

The preheater heat storage control table 125 includes a yellow table 125Y used in the yellow printing mode, a magenta table 125M used in the magenta printing mode, and a cyan table 125C used in the cyan printing mode. Each of the yellow table 125Y, the magenta table 125M, and the cyan table 125C describes count values indicating the preheat start times for the respective lines from the first line to nth line (where n is an integer) as a function of the printing mode, the temperature of the inside of the printer, and the temperature of the preheater.

More specifically, each of the yellow table 125Y, the magenta table 125M, and the cyan table 125C includes 16 tables corresponding to different ranges of the thermistor value PRT indicating the temperature of the inside of the printer. In the specific example shown in FIG. 10, the yellow table 125Y includes a table 125Y1 corresponding to a range of 0 to 15 of the thermistor value PRT, a table 125Y2 corresponding to a range of 16 to 31, a table 125Y3 corresponding to a range of 32 to 47, . . . , and a table 125Y16 corresponding to a range of 240 to 255.

Each of these 16 tables corresponding to different ranges of the thermistor value PRT includes 256 tables corresponding to different thermistor values PHT indicating the temperature of the preheater Rph. In this specific example, 256 tables included in the table 125Y1 in the yellow table 125Y are a table 125YY1 corresponding to 0 of the thermistor value PHT, a table 125YY2 corresponding to 1, a table 125YY3 corresponding to 2, . . . , and a table 125YY256 corresponding to 255.

Each of the 256 tables corresponding to different thermistor values PHT describes count values corresponding to the respective line numbers LN. In this specific example, the table 125YY1 describes a count value CLY01 corresponding to the first line (LN=1), a count value CLY02 corresponding to the second line (LN=2), . . . , and a count value CLY0n corresponding to the nth line (LN=n). Herein, respective tables 125YY1 to 125YY256 have a size equal to the sum of the number of lines and a number needed to handle a shift between the preheater Rph and the thermal head heaters R1 to R2432.

That is, for example, when the preheater Rph is disposed at a location shifted by one line toward the upstream side in the paper feeding direction with respect to the thermal head heaters R1 to R2432, each table 125YY1 to 125YY256 includes a preheat start count value used to preheat a line next to the last print line, in addition to the preheat start count values used to preheat normal print lines (there are as many preheat start count value as there area pint lines). This prevents only a printing heater from operating at the final printing line, thereby ensuring that both a printing heater and a preheating heater operate for any of lines. Thus, it becomes possible to prevent nonuniformity in the printed color intensity due to the shift between the preheaters and the thermal head heaters.

The count values (for example, CLY01 to CLY0n) described in the yellow table 125Y, the magenta table 125M, and the cyan table 125C indicate the timings of starting preheating in the respective printing modes, and thus hereinafter these count values will be referred to as "preheat start count values".

The preheat start count values described in the preheater heat storage control table 125 are determined for respective lines on the basis of experiments performed at respective temperatures such that the effective amount of heat given by the preheating process using the preheating heater becomes constant. For example, the preheat start count values CLY01 to CLY0n described in the yellow table 125Y are experimentally determined such that the printed color intensity becomes substantially equal for all lines when the thermistor value PRT indicating the temperature of the inside of the printer is within the range from 0 to 15 and the thermistor value PHT indicating the temperature of the preheater is equal to 0. Herein, the preheat start count values are experimentally determined for various thermistor values PRT and PHT immediately before staring printing. Therefore, the change in temperature during the printing operation is reflected in the preheat start count values, and thus it becomes possible to obtain a substantially equal printed color intensity over all lines.

Similarly, tables 125YY2 to 125YY256 are created by experimentally determining the preheat start count values for various ranges of thermistor values PHT and the resultant tables are incorporated into the table 125Y1. Similarly, tables 125Y2 to 125Y16 are created for various ranges of thermistor values PRT, and the obtained tables are incorporated into the yellow table 125Y. Thus, by referring to the yellow table 125Y which has been experimentally determined in the above-described manner, it is possible to select a correct preheat start count value which should be used to obtain a substantially equal printed yellow intensity for each line depending upon a given thermistor value PRT indicating the temperature of the inside of the printer and a given thermistor value PHT indicating the temperature of the preheater.

In a similar manner to the yellow table 125Y, the magenta table 125M and the cyan table 125C are prepared.

The preheat start count values determined in the above-described manner and described in the preheater heat storage control table 125 increase as the line advances. Thus, the preset value of the counter 106 is increased as the line number LN increases thereby correspondingly reducing the preheating time. As a result, the effective amount of heat given in the preheating process becomes substantially constant over all lines.

The operation of the thermal head controller shown in FIGS. 7 to 9 according to the first embodiment is described below.

The preheating is performed by the preheater Rph in parallel with the printing performed by the thermal head heaters R1 to R2432 such that when the thermal head heaters R1 to R2432 are performing printing for a certain line, the preheater performs preheating for a next line. That is, preheating is performed in parallel with a printing operation for a previous line. In other words, preheating for a next line is performed in parallel with a printing operation for a current line. Although in this specific example, preheating is performed for a line immediately before a line being printed, preheating may be performed for a particular number of lines before a line being printed.

The operation of controlling the preheating of a certain line using the preheater Rph and the operation of controlling the printing using the thermal head heaters R1 to R2432 in the yellow printing mode are described below.

(1) Controlling the Preheating Operation of the Preheater

Before starting printing a particular line of interest, a count value (preheat start count value) indicating when preheating should be started is set as a preset value CPR into the counter 106. If a data transfer control signal DM2EN changes to a low level during a printing operation performed by the thermal head heaters as will be described later, transferring of print data to the thermal head is started, and a preheat signal PH output from the flip flop 107 becomes low thereby turning off the switch SWph and thus ending the preheating.

In this state, the thermal head heater control signal generator 101 generates various thermal head heater control signals such as an enable signal ENBb, a load signal LOADb, a set signal SETb, a strobe pulse HSTR, and a clock signal D.CLK on the basis of a strobe pulse pattern selected, in accordance with a print mode signal MODE, from the strobe pulse table 100.

Figure 11:
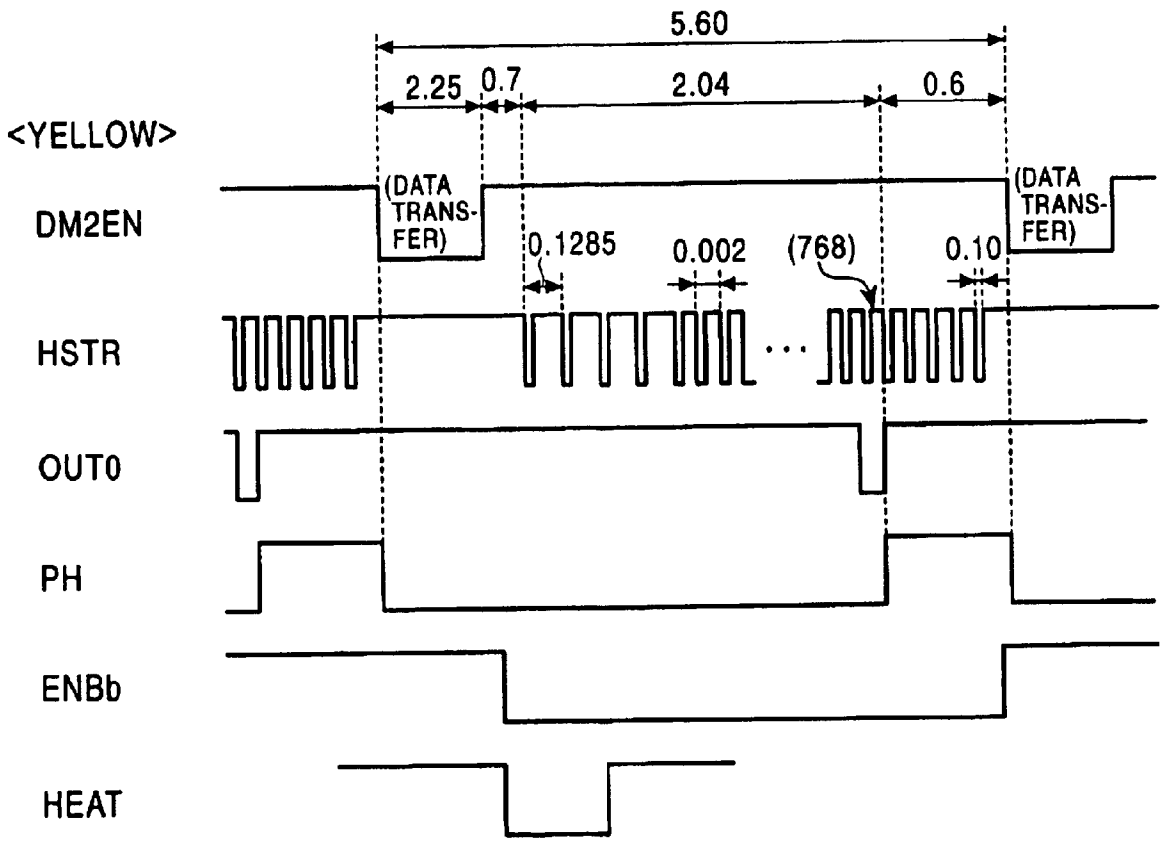
FIG. 11 is a waveform diagram illustrating an operation of controlling the thermal head (in yellow printing mode) according to the first embodiment of the present invention.

FIG. 11 illustrates an example of a waveform of the strobe signal HSTR which is one of the thermal head heater control signals generated by the thermal head heater control signal generator 101. This example of the waveform of the strobe signal HSTR is used in the yellow printing mode and has a pulse pattern consisting of a combination of 5 pulses with a period of 0.1285 msec (an on-period having a length corresponding to 255 clocks plus an off-period having a length corresponding 2 clocks) and 1019 pulses with a period of 0.002 msec (an on-period having a length corresponding to 2 clocks plus an off-period having a length corresponding 2 clocks). This pulse pattern of the strobe signal HSTR is determined so as to effectively control both the thermal head heaters R1 to R2432 and the preheater Rph and is described in the strobe pulse table 102.

In FIG. 11, the data transfer control signal DM2EN is a control signal for transferring print data DATA0 to DATA7 to the thermal head drivers DR1 to DR38 shown in FIG. 5 and has a pulse width of 2.25 msec and a period of 5.60 msec.

Figure 12:
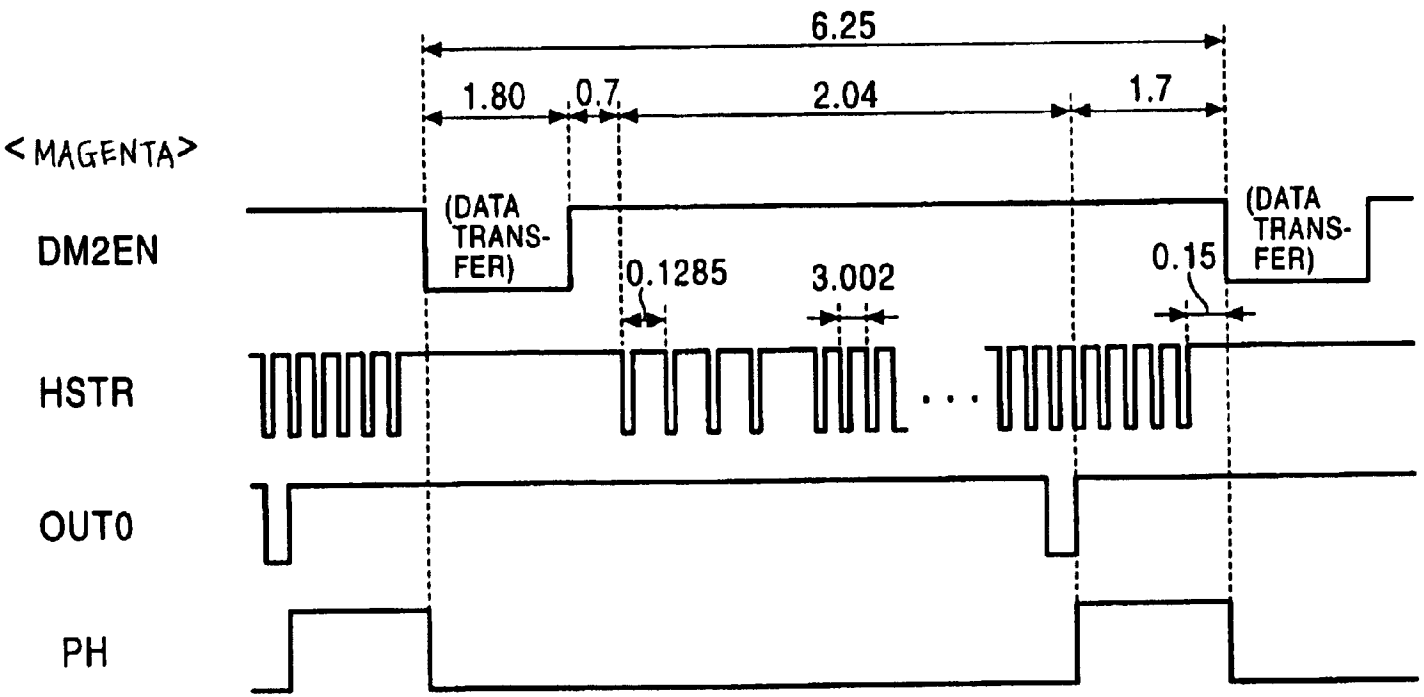
FIG. 12 is a waveform diagram illustrating an operation of controlling the thermal head (in magenta printing mode) according to the first embodiment of the present invention.
Figure 13:
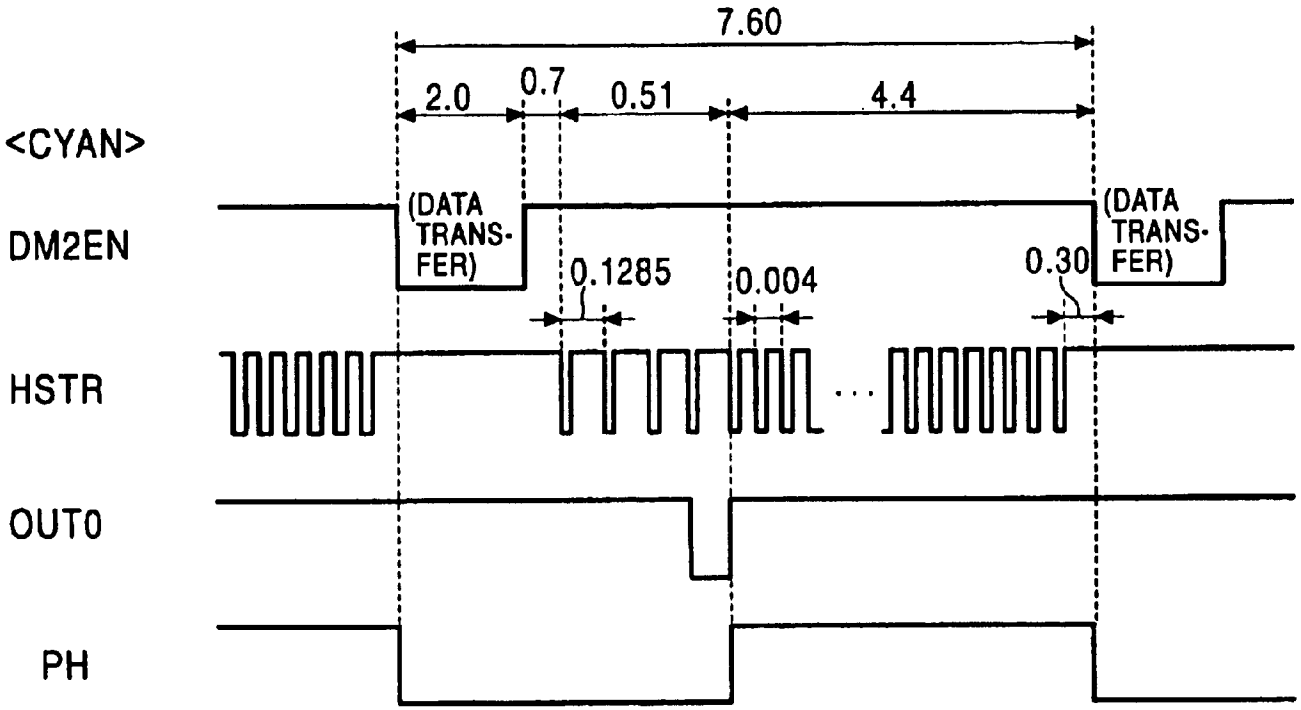
FIG. 13 is a waveform diagram illustrating an operation of controlling the thermal head (in cyan printing mode) according to the first embodiment of the present invention.

FIGS. 12 and 13 illustrate examples of strobe signals HSTR used in the magenta and cyan printing modes, respectively. In the example shown in FIG. 12, the strobe signal HSTR has a pattern consisting of a combination of 5 pulses with a period of 0.1285 msec (an on-period having a length corresponding to 255 clocks plus an off-period having a length corresponding 2 clocks) and 1019 pulses with a period of 0.003 msec (an on-period having a length corresponding to 5 clocks plus an off-period having a length corresponding 1 clock). On the other hand, in the example shown in FIG. 13, the strobe signal HSTR has a pattern consisting of a combination of 5 pulses with a period of 0.1285 msec (an on-period having a length corresponding to 255 clocks plus an off-period having a length corresponding 2 clocks) and 1019 pulses with a period of 0.004 msec (an on-period having a length corresponding to 7 clocks plus an off-period having a length corresponding 1 clock). The pulse pattern of the strobe signal HSTR is properly determined on the basis of the relationship between the printed color intensity and the energizing time for each color and is described in the strobe pulse table 100.

While various control signals are generated in the above-described manner, print data DATA0 to DATA7 are generated in a printing operation, which will be described in further detail later, by a circuit including a conversion coefficient table 102, an internal gradation converter 103, a head data buffer 104, and a head data converter 105, and transferred to the respective drivers DR1 to DR38 of the thermal head shown in FIG. 5. When the transferring of the data to the thermal head is completed, the data transfer control signal DM2EN applied to the counter 106 shown in FIG. 8 becomes high, and thus the counter 106 starts to count the pulses of the strobe signal HSTR. When the count value reaches a preset value CPR (preheat start count value) indicating a time at which the preheating should be started, the counter 106 outputs a low-level pulse as an output signal OUT0. In the example shown in FIG. 11, the counter 106 outputs a low-level pulse (OUT0) at a falling edge of a 768th pulse of the strobe signal HSTR.

The preset value CPR of the counter 106 is set by the preset value setting/correcting circuit 120 as will be described in detail later.

Upon reception of the low-level pulse (OUT0) from the counter 106, the flip flop 107 outputs a high-level (power supply voltage level) signal given in advance to a data terminal D as a preheat signal PH. The preheat signal PH is applied to the switch SWph for controlling the operation of energizing the preheater Rph. In response, the switch SWph turns on. As a result, a current is supplied to the preheater Rph and preheating is started. The period of time during which the current is supplied to the preheater is determined by the pulse width of the preheat signal PH and can be changed by changing the pulse pattern (for example, the number of clocks or pulse width) of the strobe signal HSTR or by changing the preset value CPR of the counter 106 by which the starting time of the preheating is determined.

Figure 14:
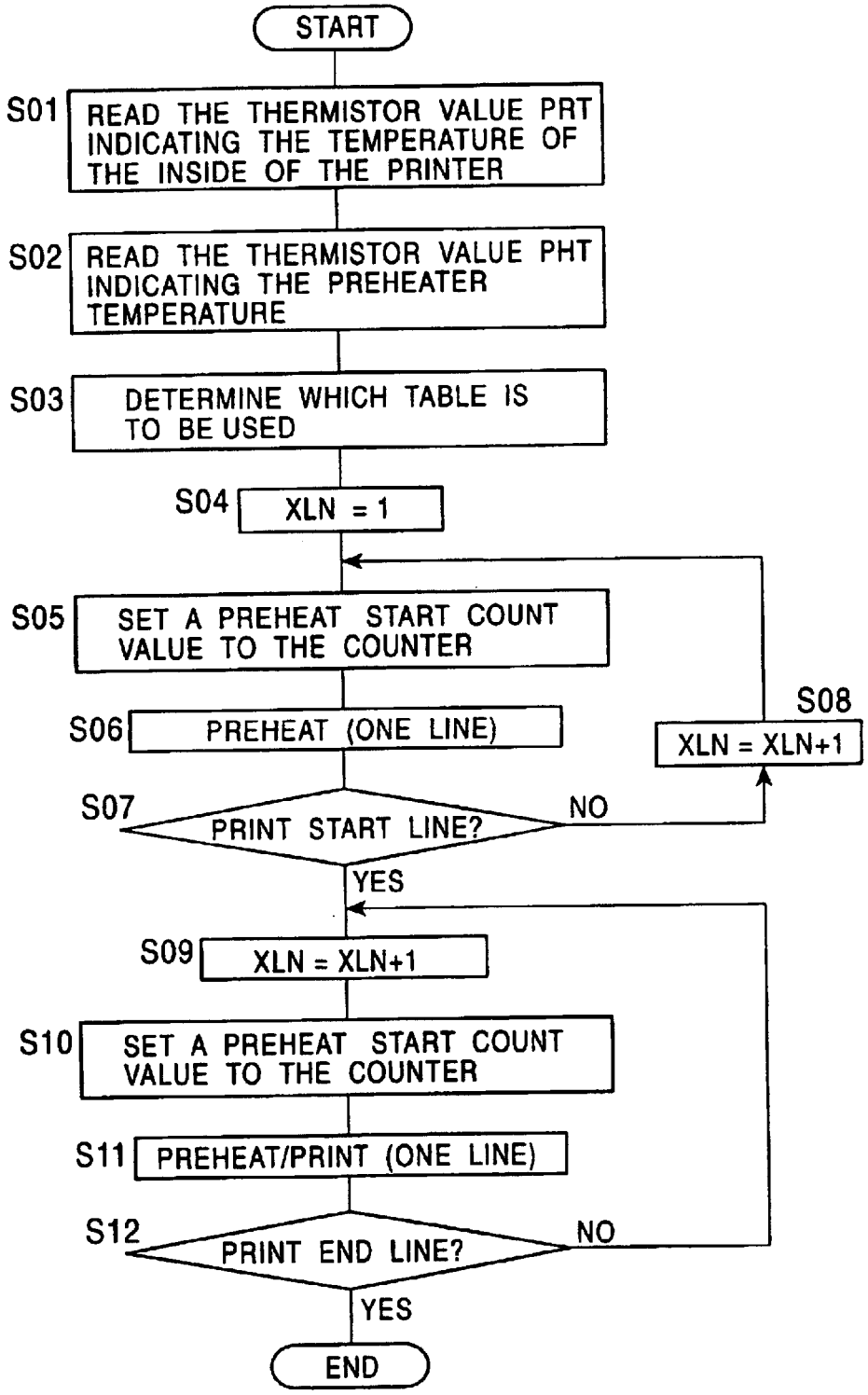
FIG. 14 is a flow chart illustrating the operation of controlling the thermal head according to the first embodiment of the present invention.

Referring to a flow chart shown in FIG. 14, the operation of the preset value setting/correction circuit 120 is described in detail.

Step S01: First, the CPU 126 reads a thermistor value PRT which is obtained by converting, using the A/D converter 122, the temperature in the inside of the printer detected by the inside-of-printer temperature detector 121 into digital form.

Step S02: Subsequently, the CPU 126 reads a thermistor value PHT which is obtained by converting, using the A/D converter, the preheater temperature Rph detected by the preheater temperature detector 123 into digital form.

Step S03: The CPU 126 then determines which table is to be used, on the basis of the print color 127, the thermistor value PRT, and the thermistor value PHT. In this specific example, the printing mode is set in the yellow printing mode. Therefore, if the thermistor value PRT indicating the temperature of the inside of the printer is equal to, for example, 15, and if the thermistor value PHT indicating the temperature of the preheater Rph is equal to, for example, 0, then the CPU 126 determines that the table 125YY1 is to be used.

Step S04: The CPU 126 sets a variable XLN indicating the line number to 1 so as to indicate the first line.

Step S05: The CPU 126 then reads, from the table selected in step S03, a preheat start count value to be set as the preset value CPR into the counter 106, for the line number indicated by the variable XLN. For example, when the variable XLN is equal to 1, the preheat start count value CLY01 (LN=1) is read from the table 125YY1 selected in step S03 and the obtained value is employed as the preset value CPR.

Step S06: After the preheat start count value is set as the preset value CPR, preheating for the first line (LN=1) is started.

Step S07: The CPU 126 then determines whether the current line is a print start line to be printed by the printing thermal head heaters R1 to R2432.

Step S08: If the current line is not a print start line (that is, if the decision in step S07 is no), the variable XLN indicating the line number is incremented by 1. After that, the process returns to step S05 and the preheating is continued until the print start line is reached (steps S05 to S07, S08). During this process, as the line number LN increases, a preheat start count value corresponding to the line number is read from the table 125YY1 and set, in step S05, as the preset value into the counter 106.

That is, the preset value CPR of the counter 106 is corrected line by line so that the preheating is started at a proper time corresponding to the preset value thereby properly controlling the preheat time for the respective lines.

Step S09: When the line being currently preheated becomes a print start line (that is, if the decision in step S07 is yes), the CPU 126 increments the variable XLN indicating the line number by 1 so that the variable XLN indicates that a line to be preheated is one next to the line being currently printed.

Step S10: The CPU 126 then reads, from the table 125YY1, a count value corresponding to the line number LN indicated by the incremented variable XLN and sets it as the preset value CPR into the counter 106.

Step S11: After the preheat start count value is set as the preset value CPR, preheating for the line next to the print start line and printing for the print start line are started.

Step S12: The CPU 126 then determines whether the line being currently printed is a last line (last print line) printed by the printing thermal head heaters R1 to R243. Because it is known which line is the last print line, the CPU 126 can determine whether the line being currently printed is the last print line on the basis of, for example, the line number.

If the line being currently printed is not the last print line (that is, if the decision in step S12 is no), the process returns to step S09 in which the variable LN indicating the line number is incremented. After that, the printing operation and the preheating operation are performed repeatedly line by line until the last print line is reached (step S09 to S12). In the above process, as the line number LN increases, a preheat start count value corresponding to the line number LN is read from the table 125YY1 and set, in step S10, as the preset value into the counter 106.

That is, as in the preheating operation for the lines before the print start line, the preset value CPR of the counter 106 is corrected line by line, and the preheating is started at the time corresponding to the preset value CPR thereby properly controlling the preheat time for the respective lines. Thus, even if the amount of heat stored in a part other than the print paper to be preheated increases as the line advances, the effective amount of preheat is maintained substantially constant over all lines, and thus nonuniformity in printed color density due to the variation in the preheating does not occur. In the present example, after the printing operation is started, the table selected in step S03 is continuously used without being changed. Because the table is experimentally determined taking into account the effects of the temperature change during the printing operation, the correct printed color intensity can be obtained even if the temperature changes during the printing operation, as long as the same table is used.

The energizing time (that is, preheating time) of the preheater Rph is determined by the pulse width of the preheat signal PH. To control the amount of heat generated in the preheating process, instead of changing the preset value CPR of the counter 106 thereby controlling the timing of starting the preheating, the pulse pattern (number of clocks or the pulse width) of the strobe signal HSTR may be changed.

(2) Controlling the Printing Operation Using the Thermal Head Heaters

In order to increase the gradation expressing precision, the internal gradation converter 103 converts 8-bit image data PDATA input together with various correction data and the conversion coefficients described in the conversion table 102 into 10-bit internal gradation data. The resultant 10-bit internal gradation data is stored in the head data buffer 104. The head data converter 105 converts, under the control of the data transfer control signal DM2EN, the 10-bit internal gradation data stored in the head data buffer 104 into 4 pieces of 8-bit data and transfers the resultant data as print data DATA0 to DATA7 to the thermal head drivers DR1 to DR38 shown in FIG. 1 wherein one piece of 8-bit data is transferred at a time and thus 4 pieces of 8-bit data are transferred by performing the transfer operation 4 times. Because 256 different gradation levels can be represented by 8 bits, as many gradation levels as 256×4=1024 can be represented by 4 pieces of 8-bit data which are transferred piece by piece.

In the thermal head shown in FIG. 5, the print data DATA0 to DATA7 received from the controller described above with reference to FIG. 7 are transferred through the drivers DR1 and DR38 from one driver to next in synchronization with the clock signal D.CLK and are latched by the drivers DR1 to DR38 as a preset value (with no sign) of a gradation counter (not shown) in response to a load signal LOADb and a set signal SETb. This preset value, unlike the preset value CPR of the counter 106 indicating when preheating should be started, indicates the color intensity of a printed image (that is, the gradation of the image) by specifying the energizing time of the thermal head heaters R1 to R2432.

As shown in FIG. 11, the respective gradation counters disposed in the drivers DR1 to DR38 count the pulses of the strobe pulse signal SHTR during a period in which the enable signal ENBb is at a low level until the count value reaches the preset values indicating the gradation level (printed color intensity) of the image. A signal HEAT having a pulse width corresponding to the preset value (gradation level) is generated, and the turning-on periods of the switches SW1 to SW2432 are controlled according to this control signal thereby controlling the energization of the thermal head heaters. In this process, the switches SW1 to SW2432 are selectively turned on according to the print data latched by the drivers DR1 to DR38 thereby selectively energizing the corresponding thermal head heaters R1 to R2433 and thus printing one line in the yellow printing mode.

As described above, the energizing time of the printing thermal head heaters R1 to R2432 are set depending upon the given gradation level indicated by the preset value set in a gradation level counter (not shown) disposed in each driver, and the thermal head heaters are selectively energized according to the print data latched by the respective drivers thereby forming one line of yellow image with a desired intensity.

Thereafter, the preheating and printing operations are repeated in a similar manner in the yellow printing mode.

After completion of the preheating and printing operation in the yellow printing mode, operations in the magenta and cyan printing mode are sequentially performed in a similar manner, so as to eventually form a color image composed of yellow, magenta, and cyan color components on print paper.

In the first embodiment, as described above, the preheating time is reduced by an amount corresponding to an amount of stored heat, wherein the preheating time is determined in accordance with, for example, the temperature (thermistor value PRT) of the inside of the printer immediately before printing is started, the temperature (thermistor value PHT) of the preheater Rph immediately before printing is started, the print color 127, the line number LN, and the preheater heat storage control table 125. According to the first embodiment, therefore, it is possible to control the amount of preheating performed by the preheater Rph line by line such that the effective amount of preheat is maintained substantially constant over all lines thereby preventing the printed color intensity from having nonuniformity. In particular, this technique prevents a color from appearing in a white-data area in which any color should not appear.

Figure 15A:
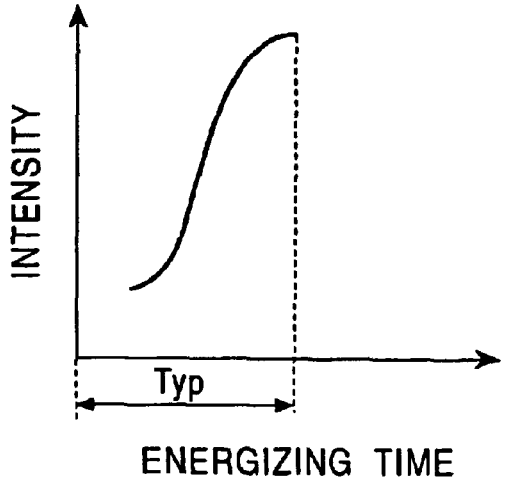
FIG. 15 illustrates the relationship between the printed color intensity and the energizing time of the thermal head according to the first embodiment of the present invention.
Figure 15B:
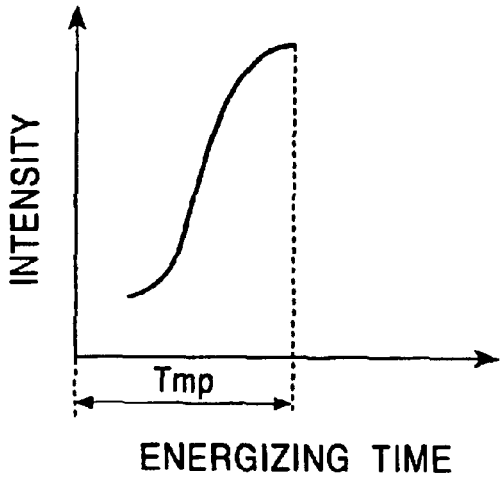
Figure 15C:
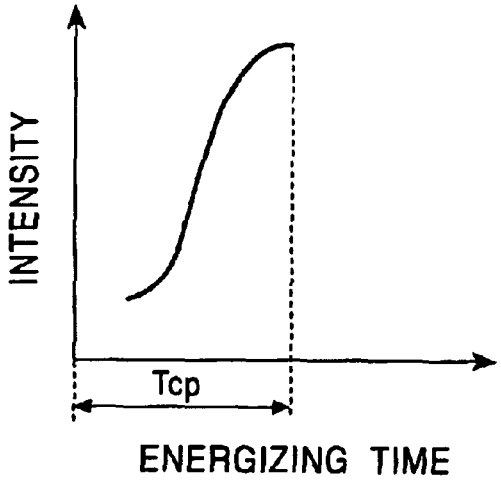

Because preheating for a current line has been performed in parallel with the operation of printing a previous line, the printing of the current line can be immediately started without needing an additional preheating time, for any of colors, yellow, magenta, and cyan. Thus, maximum color intensities can be obtained for respective colors in short energizing times Typ, Tmp, and Tcp as illustrated in FIG. 15. As a result, a greater reduction in the printing time can be achieved. Furthermore, because the strobe signal HSTR used to control the energization of the thermal head heaters is also used to control the energization of the preheater Rph, the preheating capability can be realized without needing a significant increase in the circuit size. Thus, the thermal head controller can be realized at low cost.

Controller According to the Second Embodiment

The second embodiment of the present invention is described below, with reference to the drawings used above to describe the first embodiment.

In the embodiment described above, the preset value setting/correcting circuit 120 has the preheater heat storage control table 125 including tables describing preheat start count values for the respective printing modes and for various values of the temperature of the inside of the printer and the temperature of the preheater Rph. However, in the second embodiment, the preheater heat storage control table 125 used in the first embodiment described above with reference to FIG. 9 is replaced with a preheater heat storage control table 128 shown in FIG. 18, which describes preheat start count values indicating the preheat start time at respective preheater temperatures in the respective printing modes for various values of the temperature of the inside of the printer. The other parts are similar to those in the first embodiment.

Figure 16:
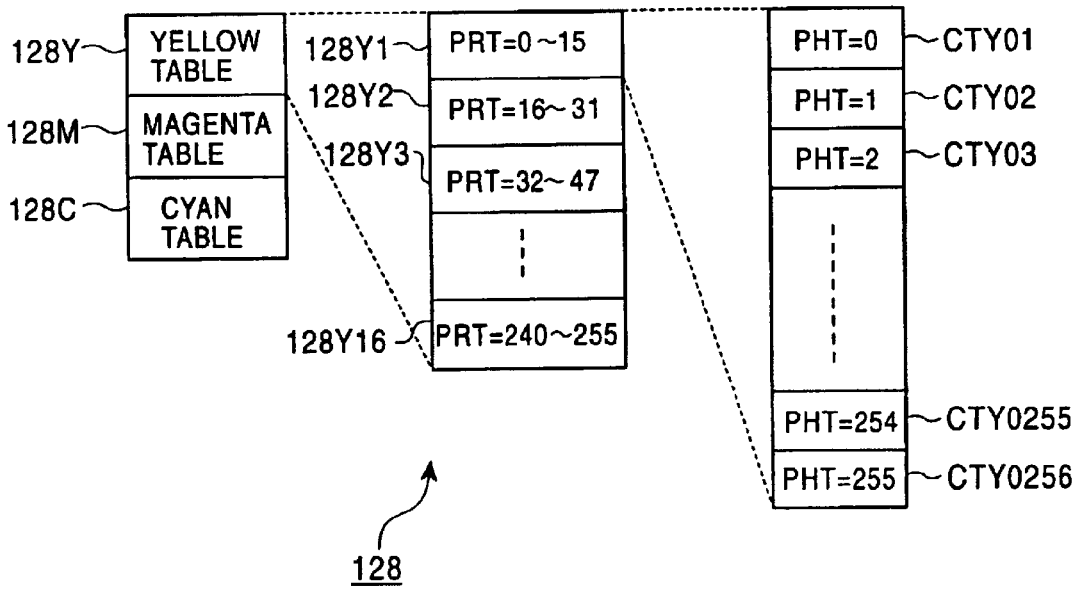
FIG. 16 illustrates a preheater heat storage control table provided in the preset value setting/correcting circuit according to the second embodiment of the present invention.

FIG. 16 illustrates an example of a preheater heat storage control table 128 according to the second embodiment.

The preheater heat storage control table 128 includes a yellow table 128Y used in the yellow printing mode, a magenta table 128M used in the magenta printing mode, and a cyan table 128C used in the cyan printing mode. Each of the yellow table 128Y, the magenta table 128M, and the cyan table 128C describes preheat start count values indicating times at which the preheating should be started depending upon the thermistor value PHT indicating the temperature of the preheater Rph, for the respective printing modes and for various ranges of the temperature inside the printer.

More specifically, each of the yellow table 128Y, the magenta table 128M, and the cyan table 128C includes 16 tables corresponding to different ranges of the thermistor value PRT indicating the temperature of the inside of the printer. In the specific example shown in FIG. 16, the yellow table 125Y includes a table 128Y1 corresponding to a range of 0 to 15 of the thermistor value PRT, a table 128Y2 corresponding to a range of 16 to 31, a table 128Y3 corresponding to a range of 32 to 47, . . . , and a table 128Y16 corresponding to a range of 240 to 255.

Each of these 16 tables corresponding to different ranges of the thermistor value PRT includes 256 tables corresponding to different thermistor values PHT indicating the temperature of the preheater Rph. In this example, the table 128Y1 describes a count value CTY01 corresponding to a thermistor value PHT of 0, a count value CTY02 corresponding to a thermistor value PHT of 1, a count value CTY03 corresponding to a thermistor value PHT of 2, . . . , a count value CTY0255 corresponding to a thermistor value PHT of 254, and a count value CTY0256 corresponding to a thermistor value PHT of 255.

the preheat start count values described in the preheater heat storage control table 128 are determined for respective lines on the basis of experiments performed at respective temperatures such that the effective amount of heat given by the preheating process using the preheating heater becomes constant. For example, the preheat start count values CLY01 to CLY0256 described in the yellow table 125Y1 are experimentally determined such that the printed color intensity becomes substantially equal when the thermistor value PRT indicating the temperature of the inside of the printer is within the range from 0 to 15.

Tables 128Y2 to 128Y16 for different ranges of the thermistor value PRT are produced in a similar manner, and the obtained tables 128Y1 to 128Y16 are incorporated into the yellow table 128Y. Thus, by referring to the yellow table 128Y which has been prepared in the above-described manner, it is possible to uniquely determine a correct preheat start count value which should be used to obtain a substantially equal printed yellow intensity depending upon a given thermistor value PRT indicating the temperature of the inside of the printer at a given thermistor value PHT indicating the temperature of the preheater.

In a similar manner to the yellow table 128Y, the magenta table 128M and the cyan table 128C are prepared.

The preheat start count values determined in the above-described manner and described in the preheater heat storage control table 128 increase with increasing temperature of the preheater Rph. Therefore, as the temperature of the preheater increases, the preset value of the counter 106 is increased, and thus the preheating time is decreased. As a result, even if heat is stored in the preheater, the effective amount of preheat given by the preheater Rph is maintained substantially constant.

Figure 17:
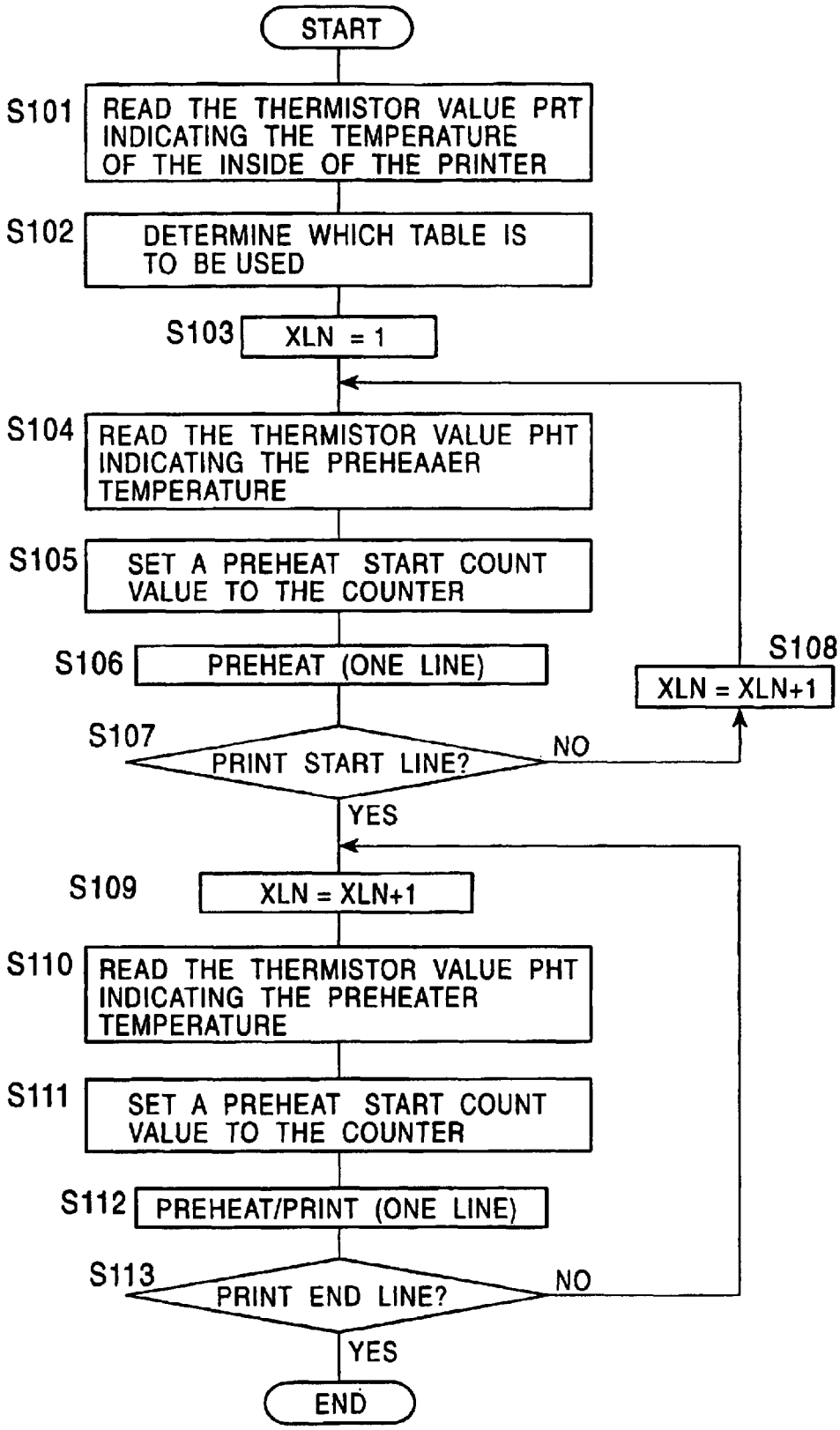
FIG. 17 is a flow chart illustrating the operation of controlling the thermal head according to the second embodiment of the present invention.

The operation of the preset value setting/correcting circuit in having the above-described preheater heat storage control table 128 according to the present embodiment is described in detail with reference to a flow chart shown in FIG. 17.

Note that operations which are not described here are performed in a similar manner as in the first embodiment.

Step S101: As in step S01 in the previous embodiment, the CPU 126 reads the thermistor value PRT indicating the temperature of the inside of the printer immediately before starting printing.

Step S102: As in step S03 in the previous embodiment, the CPU 126 determines which table is to be used in the preheater heat storage control table 128, on the basis of the print color 127 and the thermistor value PRT. For example, when the thermistor value PRT is equal to 15, because the operation is being performed in the yellow printing mode in this specific example, a table 128Y1 corresponding to the range of the thermistor value PRT from 0 to 15 is selected from the yellow table 128Y including the tables 128Y1 to 128Y16.

Step S103: As in step S04 in the previous embodiment, the CPU 126 sets a variable XLN indicating the line number to 1 so as to indicate the first line.

Step S104: The CPU 126 then reads the thermistor value PHT indicating the temperature of the preheater Rph.

Step S105: The CPU 126 then searches the table selected in step S102 according to the thermistor value PHT read in step S104 to obtain a preheat start count value to be set as the preset value CPR into the counter 106. In this specific example in which the operation is being performed in the yellow printing mode, if the thermistor value PRT indicating the temperature of the inside of the printer is equal to, for example, 15 and the thermistor value PHT indicating the temperature of the preheater Rph is equal to, for example, 0, the CPU 126 detects, from the table 128Y1 belonging to the yellow table 128Y, the preheat start count value CY01 corresponding to the thermistor value of 0 and sets the detected value as the preset value CPR into the counter 106.

Step S106: After that, preheating for the first line is started as in step S06 in the previous embodiment.

Step S107: The CPU 126 then determines whether the current line is a print start line.

Step S108: If the current line is not a print start line (that is, if the decision in step S107 is no), the variable XLN is incremented by 1, and the preheating is continued until the print start line is reached (steps S104 to S108). In each iteration of the preheating process, the preheat start count value corresponding to the thermistor value PHT indicating the preheater temperature is read from the table 128Y1 and is set as the preset value into the counter 106.

Step S109: If the current line becomes a print start line (that is, if the decision in step S107 is yes), and variable XLN is incremented so that the variable XLN indicates that the next line is to be preheated.

Step S110: The CPU 126 then reads the thermistor value PHT from the A/D converter 124.

Step S111: The CPU 126 reads, from the table selected in step S102, a preheat start count value corresponding to the thermistor value PHT read in step S110, and sets it as the preset value CPR into the counter 106.

Step S112: As in step S11 in the previous embodiment, printing upon the current line is performed while preheating the next line.

Step S113: The CPU 126 then determines whether the current line is a last print line. If the current line is not a last print line (that is, if the decision in step S113 is no), the process returns to step S109, and the printing operation and the preheating operation are performed repeatedly line by line until the last print line is reached (step S109 to S113). In each iteration of the printing and preheating operations, the preheat start count value corresponding to the thermistor value PHT is read from the table 128Y1 and is set, in step S110, as the preset value CPR into the counter 106.

In the second embodiment, as described above, in accordance with the temperature of the inside of the printer (thermistor value PRT) immediately before starting printing, the temperature of the preheater Rph (thermistor value PHT), the print color 127, and the preheater heat storage control table 128, the preheating time is reduced by an amount corresponding to the amount of stored heat so that the effective amount of heat given in the preheating process becomes equal regardless of the difference in the preheater temperature. That is, in the second embodiment, the amount of heat given in the preheating process using the preheater is controlled depending upon the temperature of the preheater Rph, and thus nonuniformity in printed color intensity does not occur. Furthermore, it is possible to prevent a color from appearing in a white-data area in which any color should not appear.

Furthermore, as in the first embodiment, preheating is performed in parallel with printing. Therefore, no additional time for preheating is needed, and thus a great reduction in the printing time is achieved. Furthermore, because the strobe signal HSTR used to control the energization of the thermal head heater is also used to control the energization of the preheater Rph, the preheating capability can be realized without needing a significant increase in the circuit size. Thus, the thermal head controller can be realized at low cost.

Controller According to the Third Embodiment

The third embodiment of the present invention is described below.

Figure 18:
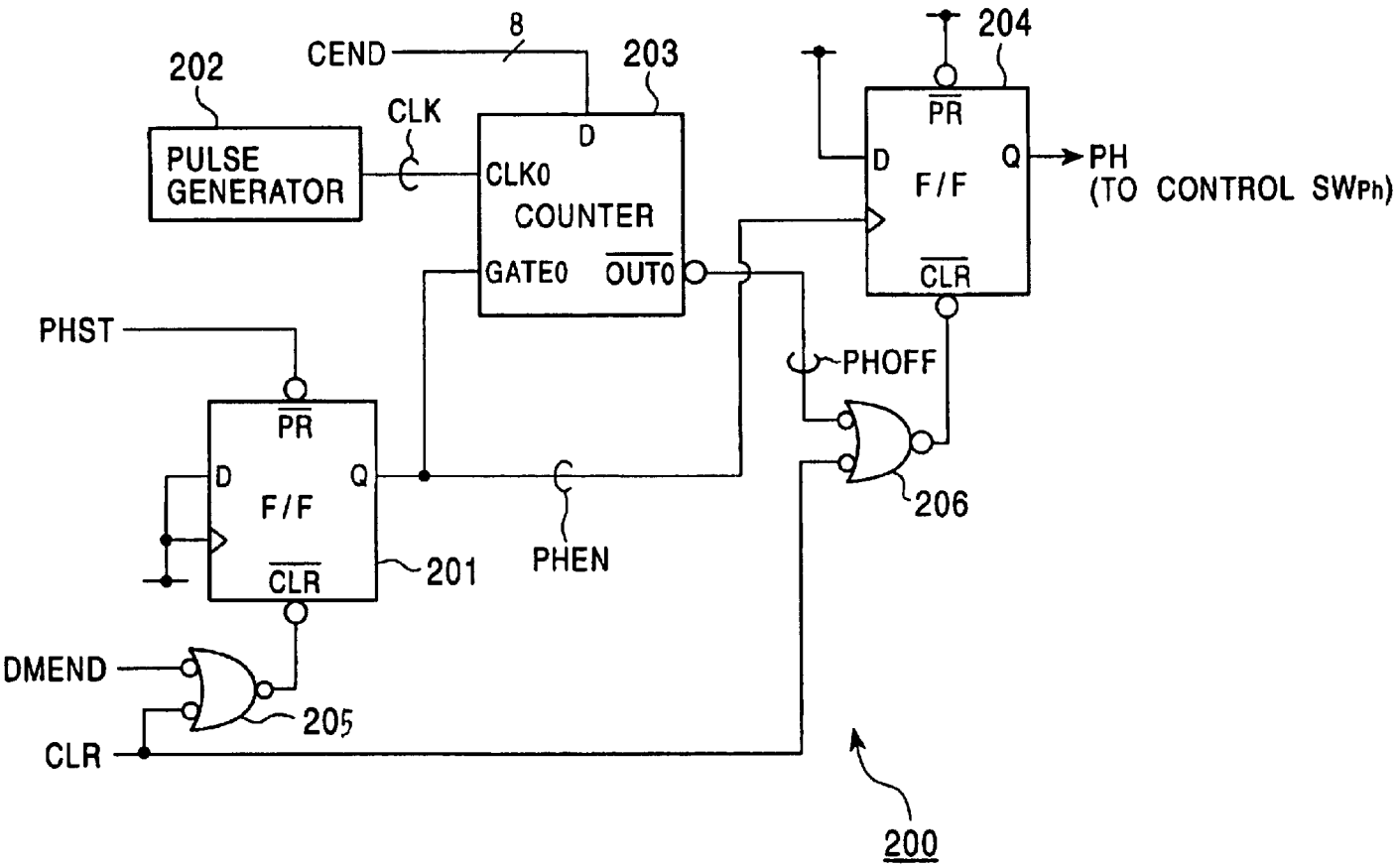
FIG. 18 is a block diagram illustrating a thermal head controller (preheat signal generator) according to the third embodiment of the present invention.

In the first and second embodiments, a preheat signal generator 110 for controlling the timing of starting the preheating is employed as the preheating control means for controlling the preheating performed by the preheater Rph. However, in the thermal head controller according to the third embodiment, a preheat signal generator 200 shown in FIG. 18 is employed instead of the preheat signal generator 110 as the preheating control means whereby, in each printing cycle, the preheating heater is energized during a period prior to starting printing (that is, during a period in which printing is not performed) and thus the thermal head is driven such that the preheating and the printing are not performed at the same time. The other parts are similar to those in the first embodiment.

In FIG. 18, reference numeral 201 denotes a flip flop which generates, in response to starting of a printing cycle for each line, a preheat enable signal PHEN which determines the timing of starting energization of the preheater Rph. The data terminal and the clock terminal of this flip flop 201 are both fixed at the power supply voltage, and the preheat start pulse PHST generated by the CPU 126 is applied to the preset terminal of the flip flop 201.

Reference numeral 202 denotes a pulse generator for generating a clock pulse signal CLK with a fixed period. The clock pulse signal CLK is used in a counting operation to detect a preheat end time, as will be described later.

Reference numeral 203 denotes a counter which counts the clock pulse signal CLK and outputs a preheat off signal PHOFF when the count value reaches a value (preheat end count value) indicating the preheat end time. The energization end time of the preheater Rph controlled by the preheat off signal PHOFF is set before starting energization of the thermal head heaters R1 to R2432. The preheat end count value CEND is set as the preset value into the counter 203. The preheat end count value CEND is experimentally determined for each color of yellow, magenta, and cyan, such that the preheating is ended immediately before a color starts to appear. More specifically, the preheat end count value CEND indicates the count value of clock pulse CLK corresponding to the preheat time.

Reference numeral 204 denotes a flip flop which generates, in accordance with the preheat enable signal PHEN and the preheat off signal PHOFF, a preheat signal PH which is activated over a period from the energization start time to the energization end time of the preheating heater Rph. The data terminal of this flip flop 204 is fixed at the power supply voltage, and the preheat enable signal PHEN output from the flip flop 201 is applied to the clock terminal of the flip flop 204. The preset terminal of the flip flop 204 is also fixed at the power supply voltage. A signal output from a gate 206, which will be described later, is applied to the clear terminal of the flip flop 204.

Reference 205 denotes a gate (negative logic input NOR gate) which clears the flip flop 201 in response to a data transfer end pulse signal DMEND and a clear signal CLR output from the CPU 126. Reference 206 denotes a gate (negative logic input NOR gate) which clears the flip flop 204 in response to the preheat off signal PHOFF and the clear signal CLR.

The operation of the thermal head controller according to the third embodiment is described below with reference to a waveform diagram shown in FIG. 19.

Before stating printing, the preheat end count value CEND is set as the preset value into the counter 203. Upon reception of the preheat start pulse signal PHST output from the CPU 126, the flip flop 201 activates the preheat enable signal PHEN to a high level. On the other hand, upon reception of the data transfer end pulse signal EMEND (signal generated in response to a rising edge of a data transfer control signal DM2EN), the flip flop 201 deactivates the preheat enable signal PHEN to a low level.

If the preheat enable signal PHEN becomes high in response to the preheat start pulse signal PHST, the flip flop 204 activates the preheat signal PH to a high level in response to the preheat enable signal PHEN. As a result, the switch SWph is turned on and the preheater Rph starts preheating.

The counter 203 counts the clock pulse signal CLK output from the pulse generator 202. When the count value reaches the preheat end count value CEND, the counter 203 outputs a low-level preheat of signal PHOFF. Upon reception of the preheat off signal PHOFF, the flip flop 204 deactivates the preheat signal PH to the low level from the high level in the previous state. As a result, the switch Wph is turned off, and the preheater Rph ends the preheating.

Figure 19:
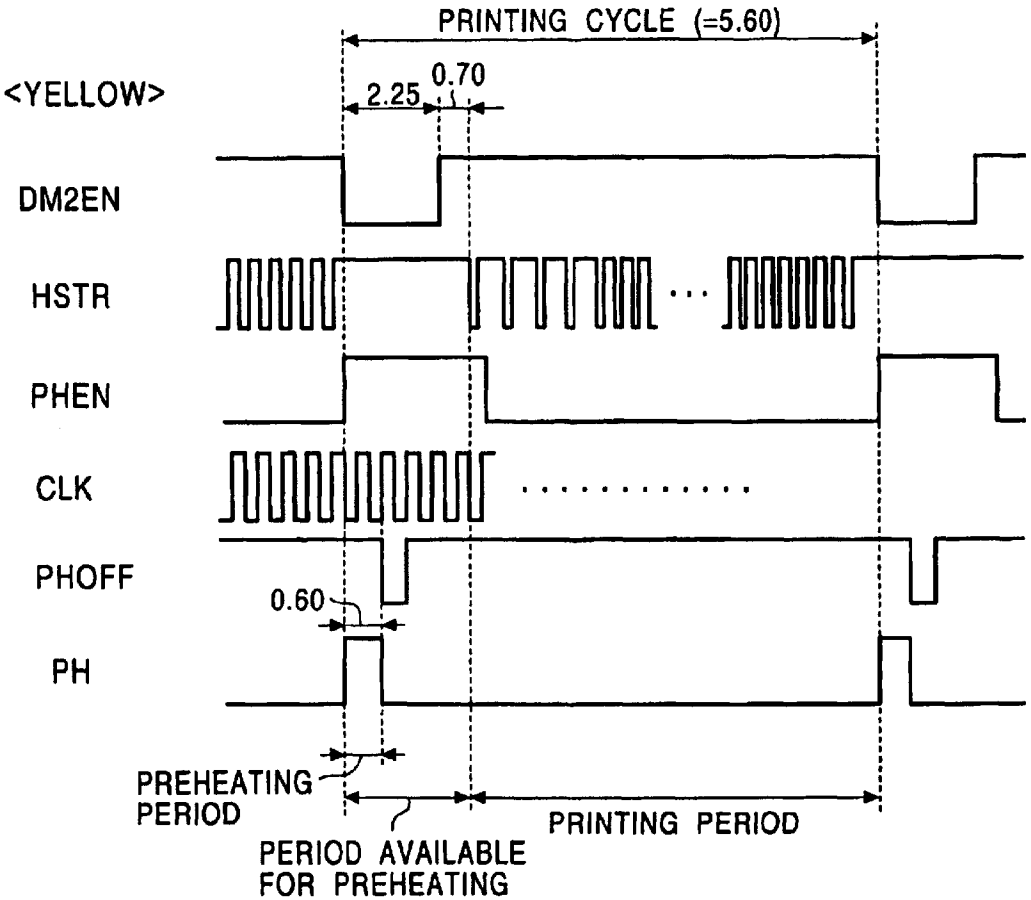
FIG. 19 is a waveform diagram illustrating an operation of controlling the thermal head (in yellow printing mode) according to the third embodiment of the present invention.

That is, in FIG. 19, the preheat signal PH is activated into the high level at a rising edge of the preheat enable signal PHEN and deactivated into the low level at a falling edge of the preheat off signal PHOFF, whereby the preheater Rph performs preheating during a period in which the preheat signal PH is in the active state. Herein, because the preheat off signal PHOFF which determines the timing of ending the preheating becomes low when the count value of the clock pulse CLK reaches the preheat end count value CEND, the preheat time and thus the amount of heat generated in the preheating process is controlled by the preheat end count value CEND. As described earlier, the preheat end count value CEND is experimentally determined for each color.

In the example shown in FIG. 19, the data transfer period controlled by the data transfer control signal DM2EN is set to 2.25 msec. When 0.70 msec has elapsed after the end of the data transfer period, a printing period is started during which printing is performed by the thermal head heaters R1 to R2432. Furthermore, in this example, the preheating time (preheating time) controlled by the preheat signal PH is set to 0.60 msec. A period from the beginning of the preheat period to the beginning of the printing period is available for preheating.

Thus, in a printing cycle for each line, the preheating using the preheater is performed before the printing period, and the printing using the thermal head heaters is performed in the printing period after the end of the preheating.

Figure 20:
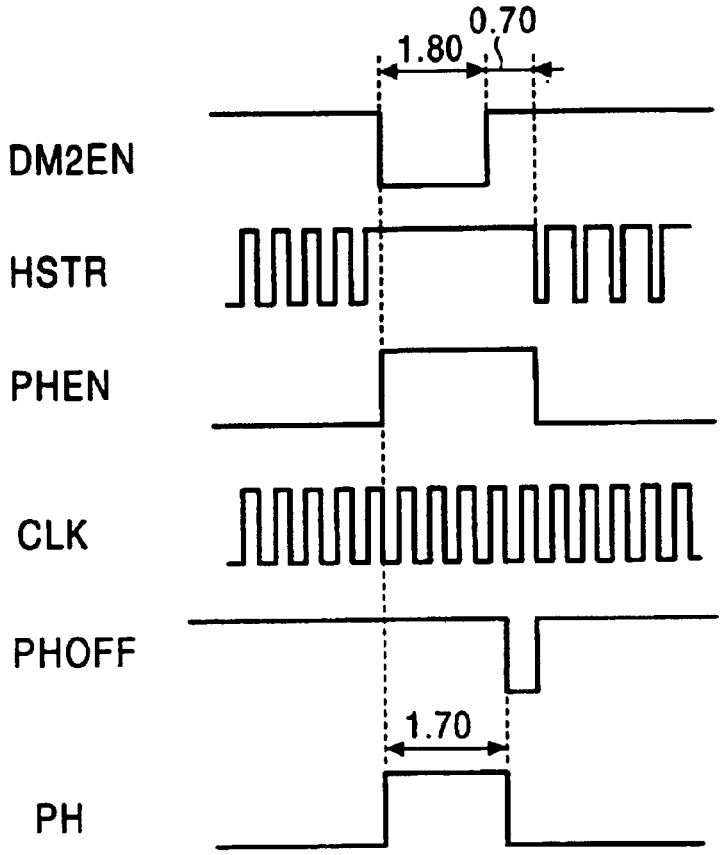
FIG. 20 is a waveform diagram illustrating an operation of controlling the thermal head (in magenta printing mode) according to the third embodiment of the present invention.
Figure 21:
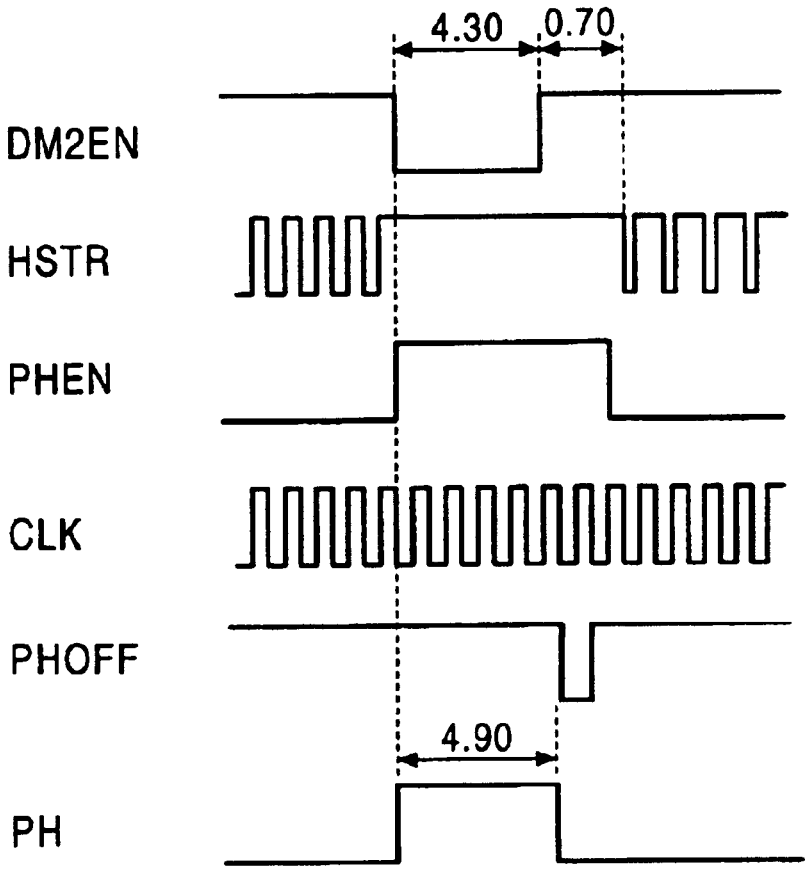
FIG. 21 is a waveform diagram illustrating an operation of controlling the thermal head (in cyan printing mode) according to the third embodiment of the present invention.

FIGS. 20 and 21 illustrate examples of waveforms of the preheat signal used in the magenta and cyan printing modes, respectively. In the magenta printing mode shown in FIG. 20, the data transfer period controlled by the data transfer control signal DM2EN is set to 1.80 msec. When 0.70 msec has elapsed after the end of the data transfer period, the printing period is started during which printing is performed by the thermal head heaters R1 to R2432. In this case, the preheating time (preheating time) controlled by the preheat signal PH is set to 1.70 msec. In the cyan printing mode shown in FIG. 21, the data transfer period controlled by the data transfer control signal DM2EN is set to 4.30 msec. When 0.70 msec has elapsed after the end of the data transfer period, the printing period is started during which printing is performed by the thermal head heaters R1 to R2432. In this case, the preheating time (preheating time) controlled by the preheat signal PH is set to 4.90 msec.

Figure 22:
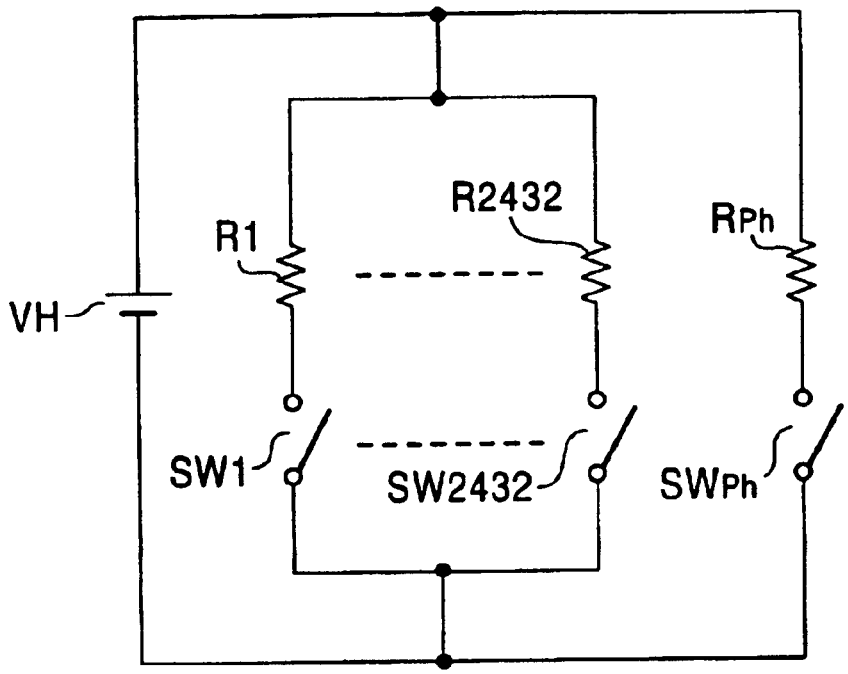
FIG. 22 illustrates thermal head heaters and associated components according to the third embodiment of the present invention.
Figure 23A:
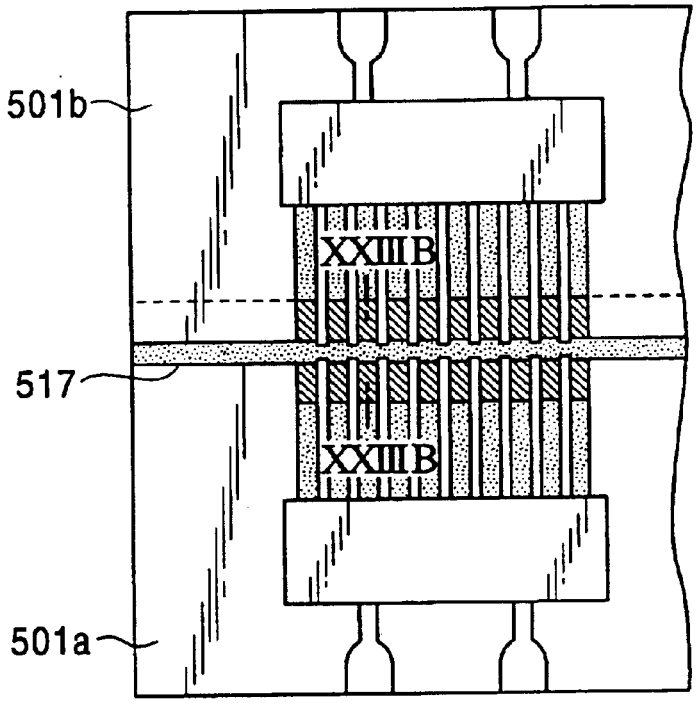
FIG. 23 is a block diagram illustrating a structure of a conventional thermal head.
Figure 23B:
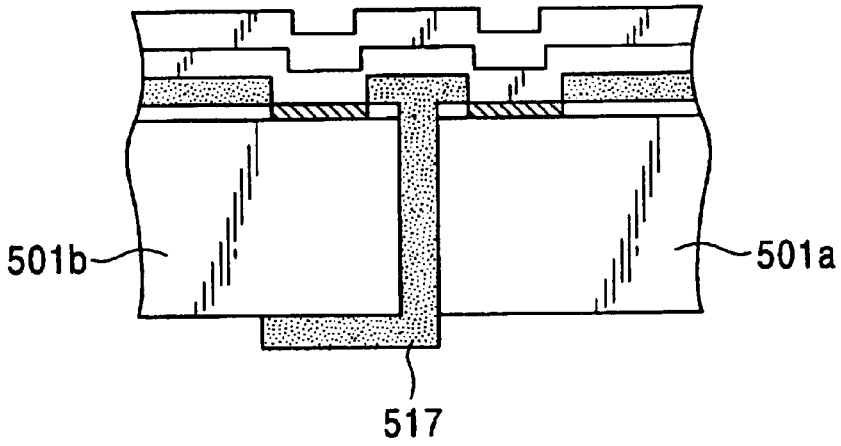
Figure 24A:
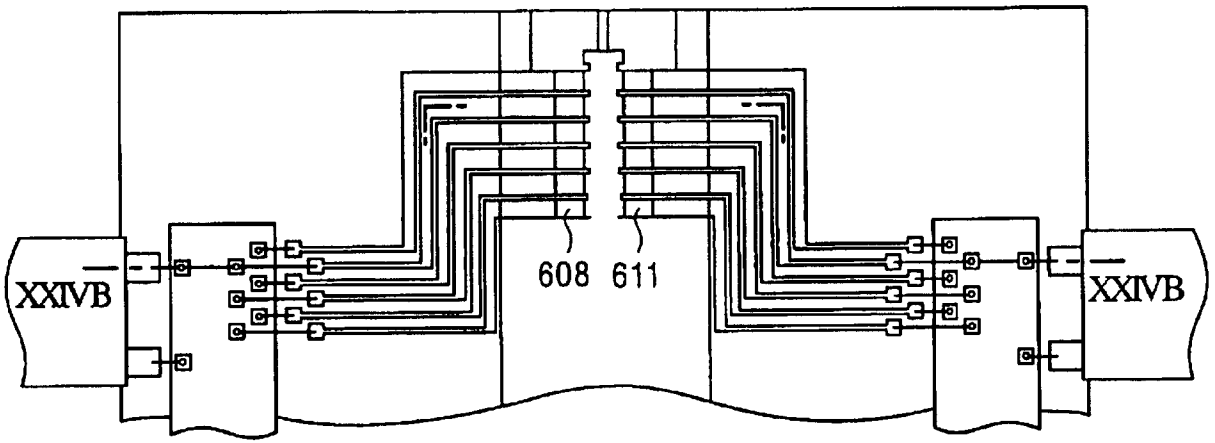
FIG. 24 is a block diagram illustrating a structure of a conventional thermal head.
Figure 24B:
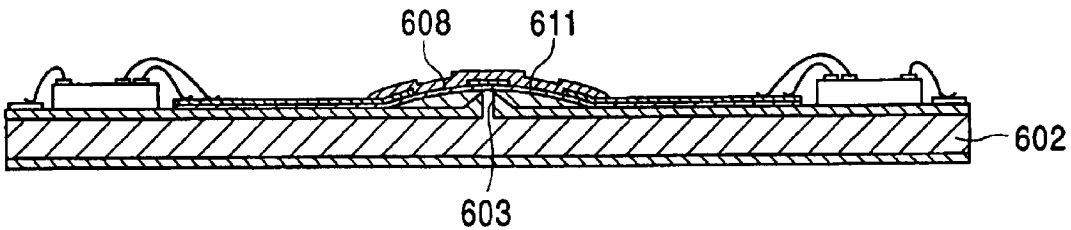
Figure 25A:
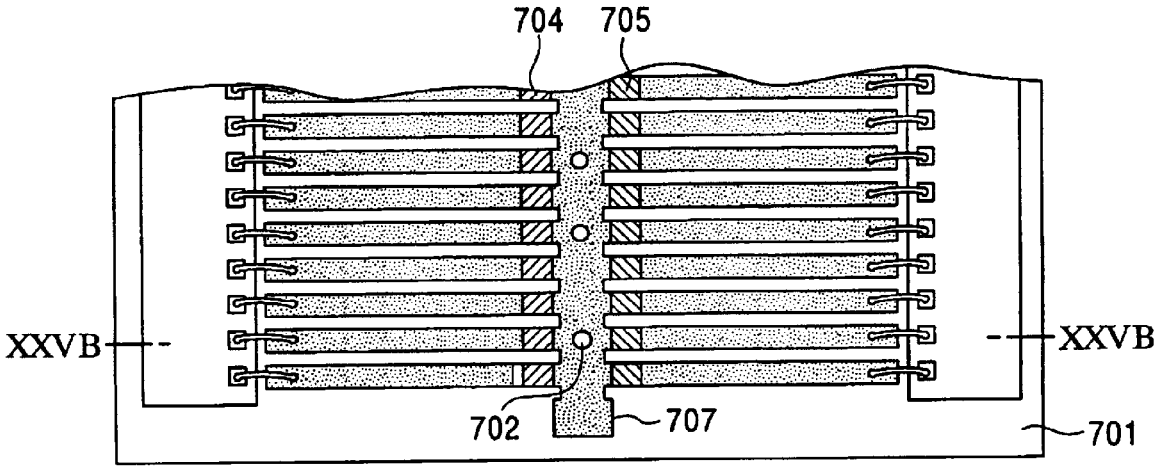
FIG. 25 is a block diagram illustrating a structure of a conventional thermal head.
Figure 25B:
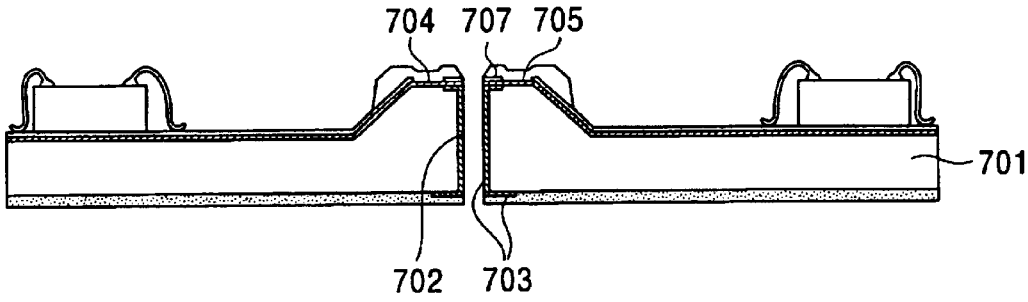
Figure 26A:
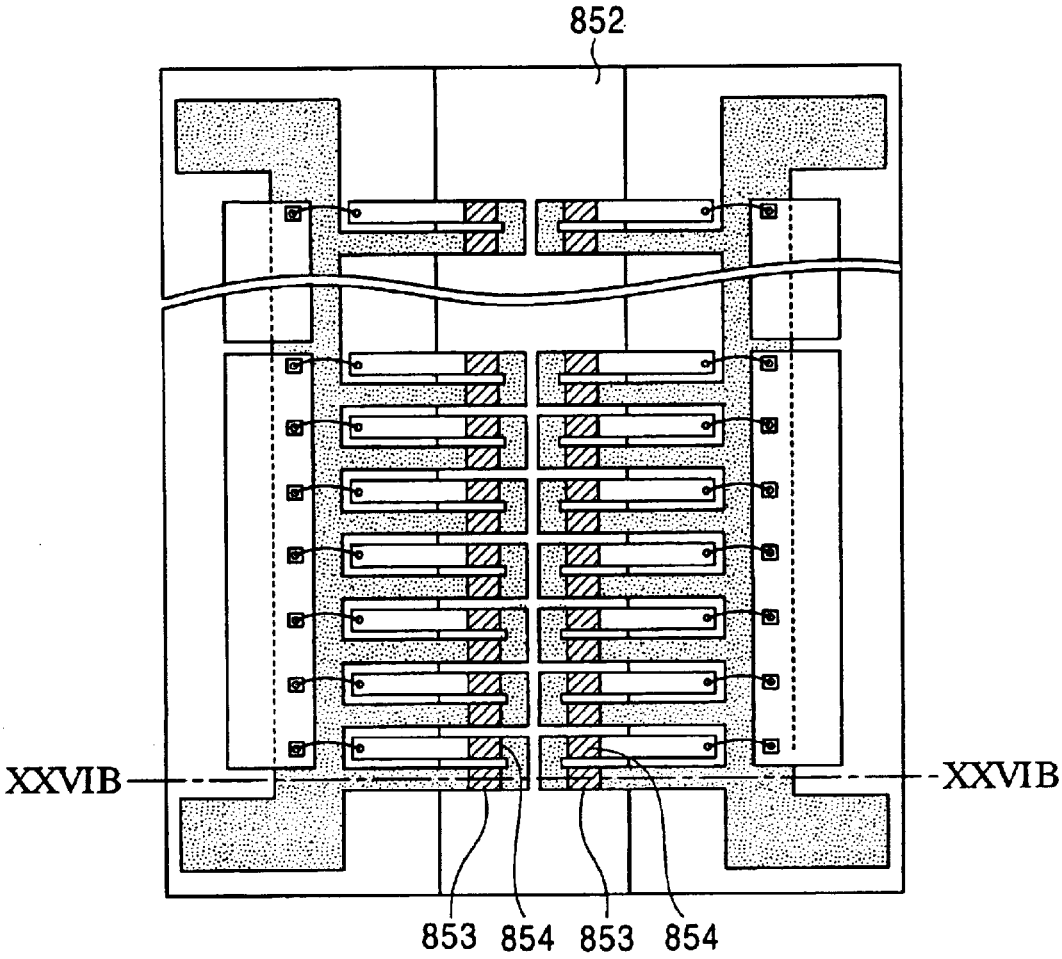
FIG. 26 is a block diagram illustrating a structure of a conventional thermal head.
Figure 26B:
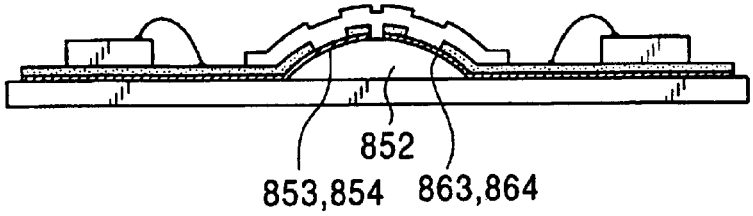
Figure 27:
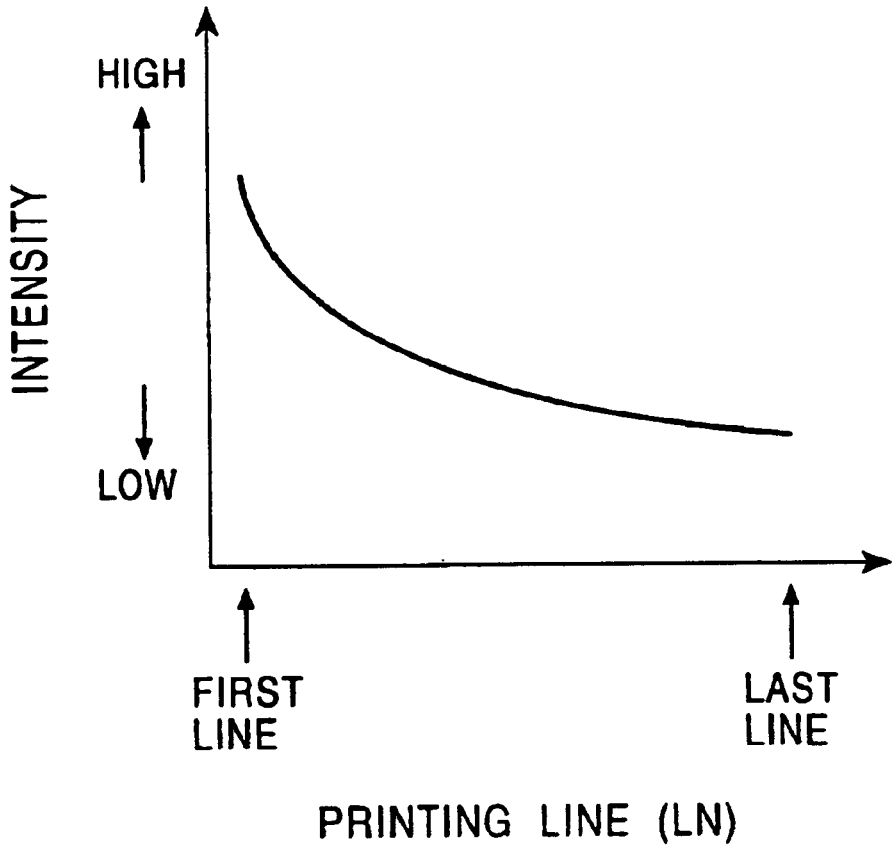
FIG. 27 is a graph illustrating the relationship between the printing line and the intensity of a color printed by a thermal head according to a conventional technique.

In the third embodiment, as described above with reference to FIGS. 19 to 21, the period available for preheating is set in a period before the printing period so that there is no overlap between the preheat period and the printing period. Therefore, in the same printing cycle, the preheating using the preheater Rph and the printing using the thermal head heaters R1 to R2432 are not performed at the same time. This makes unnecessary to use a high-voltage/high-current power supply to drive the thermal head. More specifically, in the configuration shown in FIG. 6, the power supply VL connected in series to the power supply VH becomes unnecessary, and it becomes possible to drive both the preheater Rph and the thermal head heaters R1 to R2432 using only the power supply VH as shown in FIG. 22. Thus, it possible to construct the thermal head controller in a simplified fashion.

Furthermore, in the third embodiment, in the yellow and magenta printing modes in which the preheating time is rather short, the preheating can be performed during a period in which printing using the thermal head heaters is not performed (for example, during a software processing period or a period in which data is transferred to the thermal head). Therefore, the printing can be performed in a similar period (at a similar printing speed) to that according to the first or second embodiment without needing an additional preheating time.

In contrast, high energy is needed to develop a color of cyan. Therefore, a long preheating period is needed in the cyan printing mode. Thus, in the cyan printing mode, there is a possibility that the software processing time plus the period in which data is transferred to the thermal head is not sufficient. In this case, for example, the software processing time is increased by a proper amount to obtain a necessary preheating time. Although the printing speed in the third embodiment is lower than in the first or second embodiment, it is much higher than is achieved by the conventional thermal head control technique having no preheating capability.

Although the present invention has been described above with reference specific embodiments, the present invention is not limited to those embodiments. Various modifications may be made without departing from the scope of the present invention. For example, although in the embodiments described above, colors of yellow, magenta, and cyan are printed, the present invention may also be applied to other colors if the pulse pattern of the strobe signal and the preset values of the counters 106 and 203 are properly set depending upon the colors.

Although in the first embodiment, the preheating time is controlled for each line on the basis of the temperature of the inside of the printer, the preheater temperature, and the line number, the present invention is not limited to such a manner of controlling the preheating time. The preheating time may be controlled in units of a plurality of lines. Furthermore, the preheating time may also be controlled by measuring the elapsed time from the start of a printing or preheating process.

In the second embodiment, the preheating is controlled on the basis of the thermistor value PHT indicating the temperature of the preheater. Alternatively, a plurality of ranges of the thermistor value PHT may be defined, and the preheating time (the preheat start time and the preheat end time) may be controlled depending which range the thermistor value PHT falls in.

In the first to third embodiments, the amount of heat generated in the preheating process is adjusted by controlling the preheating time. Alternatively, the amount of heat generated in the preheating process may be adjusted by controlling the current passed through the preheater Rph.

What is claimed is:

1. A thermal bead comprising:

a metal substrate;

an insulating layer formed on the surface of said metal substrate;

a plurality of heating elements disposed on the surface of said insulating layer, said heating elements being arranged with a predetermined pitch along a plurality of lines in a main scanning direction, said plurality of lines being spaced from each other in a paper feeding direction perpendicular to the main scanning direction; and a heat radiating element projecting from the surface of said metal substrate to the side where said insulating layer is disposed, wherein current does not flow through said heat radiating element to said heating elements, and wherein said heat radiating element is disposed at least in a part of a region between said metal substrate and a gap between one line of said heating elements and an adjacent line of said heating elements, and wherein a part, in contact with one line of said heating elements, of said insulating layer and a part, in contact with a directly adjacent line of said heating elements, of said insulating layer are connected to each other in a region in contact with said gap so that heat can be conducted therebetween.

2. The thermal head according to claim 1, wherein a part, in contact with one line of said heating elements, of said insulating layer and a part, in contact with a directly adjacent line of said heating elements, of said insulating layer are separated from each other by said heat radiating element.

3. The thermal head according to claim 1, wherein said heat radiating element is formed integrally with said metal substrate.

4. The thermal head according to claim 1, wherein portions, in contact with said heating elements, of said insulating layer protrude in a direction toward said heating elements.

5. The thermal head according to claim 1, wherein said heating elements are disposed such that the location, in the main scanning direction, of each heating element is coincident with the location of one of heating elements arranged in an adjacent line.

6. The thermal head according to claim 1, wherein said metal substrate includes a fin formed on a side opposite to the side on which said insulating layer is formed.

7. The thermal head according to claim 1, wherein two conductor patterns for supplying a current to each heating element to generate heat are connected to each heating element, on the side opposite to said insulating layer.

8. The thermal head according to claim 1, wherein one of said heating elements in one line and one of said heating elements in a directly adjacent line of the one line are separated from each other.

9. The thermal head according to claim 1, wherein an electrode for supplying a current to each heating element to generate heat is insulated from said metal substrate.

10. A thermal head comprising:

a metal substrate;

an insulating layer formed on the surface of said metal substrate;

a plurality of heating elements disposed on the surface of said insulating layer, said heating elements being arranged with a predetermined pitch along a plurality of lines in a main scanning direction, said plurality of lines being spaced from each other in a paper feeding direction perpendicular to the main scanning direction; and a heat radiating element projecting from the surface of said metal substrate to the side where said insulating layer is disposed, wherein current does not flow through said heat radiating element to said heating elements, wherein said heating elements are disposed such that the location, in the main scanning direction, of each heating element is shifted by ½ pitch relative to the location of one of heating elements arranged in an adjacent line.

11. The thermal head according to claim 10, wherein a part, in contact with one line of said heating elements, of said insulating layer and a part, in contact with a directly adjacent line of said heating elements, of said insulating layer are separated from each other by said heat radiating element.

12. The thermal head according to claim 10, wherein said heat radiating element is formed integrally with said metal substrate.

13. The thermal head according to claim 10, wherein portions, in contact with said heating elements, of said insulating layer protrude in a direction toward said heating elements.

14. The thermal head according to claim 10, wherein said heating elements are disposed such that the location, in the main scanning direction, of each heating element is coincident with the location of one of heating elements arranged in an adjacent line.

15. The thermal head according to claim 10, wherein said metal substrate includes a fin formed on a side opposite to the side on which said insulating layer is formed.

16. The thermal head according to claim 10, wherein two conductor patterns for supplying a current to each heating element to generate heat are connected to each heating element, on the side opposite to said insulating layer.

17. A thermal head comprising:

a metal substrate;

an insulating layer formed on the surface of said metal substrate;

a plurality of heating elements disposed on the surface of said insulating layer, said heating elements being arranged with a predetermined pitch along a plurality of lines in a main scanning direction, said plurality of lines being spaced from each other in a paper feeding direction perpendicular to the main scanning direction; and a heat radiating element projecting from the surface of said metal substrate to the side where said insulating layer is disposed, wherein said heat radiating element is disposed at least in a part of a region between said metal substrate and a gap between one line of said heating elements and an adjacent line of said heating elements, and wherein a part, in contact with one line of said heating elements, of said insulating layer and a part, in contact with a directly adjacent line of said heating elements, of said insulating layer are connected to each other in a region in contact with said gap so that heat can be conducted therebetween.

18. A thermal head comprising:

a metal substrate;

an insulating layer formed on the surface of said metal substrate;

a plurality of heating elements disposed on the surface of said insulating layer, said heating elements being arranged with a predetermined pitch along a plurality of lines in a main scanning direction, said plurality of lines being spaced from each other in a paper feeding direction perpendicular to the main scanning direction; and a heat radiating element projecting from the surface of said metal substrate to the side where said insulating layer is disposed, wherein said heating elements are disposed such that the location, in the main scanning direction, of each heating element is shifted by ½ pitch relative to the location of one of heating elements arranged in an adjacent line.

* * * * *